US012012249B2

(12) United States Patent
Tsuruta et al.

(10) Patent No.: US 12,012,249 B2
(45) Date of Patent: Jun. 18, 2024

(54) VERTICAL BAG-MAKING/FILLING/PACKAGING MACHINE, MANUFACTURING METHOD OF FILM PACKAGING BAG WITH CONTENT

(71) Applicant: ORIHIRO ENGINEERING CO., LTD., Tomioka (JP)

(72) Inventors: Masataka Tsuruta, Tomioka (JP); Katsumi Nagai, Tomioka (JP); Akira Yamaguchi, Tomioka (JP); Takayuki Yokoyama, Tomioka (JP)

(73) Assignee: ORIHIRO ENGINEERING CO., LTD., Tomioka (JP)

( * ) Notice: Subject to any disclaimer, the term of this patent is extended or adjusted under 35 U.S.C. 154(b) by 219 days.

(21) Appl. No.: 16/614,554

(22) PCT Filed: Apr. 27, 2018

(86) PCT No.: PCT/JP2018/017194
§ 371 (c)(1),
(2) Date: Nov. 18, 2019

(87) PCT Pub. No.: WO2018/225422
PCT Pub. Date: Dec. 13, 2018

(65) Prior Publication Data

US 2020/0087009 A1 Mar. 19, 2020

(30) Foreign Application Priority Data

Jun. 8, 2017 (JP) ..... 2017-113600

(51) Int. Cl.
*B65B 9/213* (2012.01)
*B65B 3/28* (2006.01)
(Continued)

(52) U.S. Cl.
CPC ..... *B65B 9/213* (2013.01); *B65B 3/28* (2013.01); *B65B 41/16* (2013.01); *B65B 51/30* (2013.01); *B65B 61/06* (2013.01)

(58) Field of Classification Search
CPC ..... B65B 9/213; B65B 3/28; B65B 41/16; B65B 51/30; B65B 61/06
See application file for complete search history.

(56) References Cited

U.S. PATENT DOCUMENTS 4,055,032 A * 10/1977 Hammond ..... B29C 66/1122 53/410
4,077,186 A * 3/1978 Voegele ..... B65B 9/2035 53/451
(Continued)

FOREIGN PATENT DOCUMENTS

CN 203806219 U 9/2014
JP 61-178807 A 8/1986
(Continued)

OTHER PUBLICATIONS

International Search Report dated Aug. 7, 2018, issued in counterpart International Application No. PCT/JP2018/017194 (2 pages).
(Continued)

*Primary Examiner* — Anne Marie Antonucci
*Assistant Examiner* — Luis G Del Valle
(74) *Attorney, Agent, or Firm* — WHDA, LLP

(57) ABSTRACT

A vertical bag-making/filling/packaging machine (1) comprises: a film supply portion (5); a film engaging portion (31) which is engaged with a film (F); a vertical seal portion (60) which makes the film (F) into a tubular shape; a film conveying portion (50); a film clamp (34) which holds the film (F) at the film engaging portion (31); a film tension releasing portion (20) which loosens the film (F); a filling portion (70) which inputs the content (X); a weighing portion (40) which weighs the content (X); a lateral sealing
(Continued)

portion (80) which makes the film (F) into a bag body (G); and a cutter which cuts off the bag body (G).

17 Claims, 11 Drawing Sheets

(51) Int. Cl.
*B65B 41/16* (2006.01)
*B65B 51/30* (2006.01)
*B65B 61/06* (2006.01)

(56) References Cited

U.S. PATENT DOCUMENTS 4,353,196 A * 10/1982 Beer ..... B29C 66/81457 53/51
4,566,253 A * 1/1986 Jones ..... B65B 9/2014 226/88
4,571,926 A * 2/1986 Scully ..... B65B 51/303 53/170
4,718,217 A * 1/1988 Ross ..... B65B 9/2028 53/529
4,924,656 A * 5/1990 Kovacs ..... B65B 43/52 53/529
5,317,858 A 6/1994 Hanai
6,170,776 B1 * 1/2001 Martin-Cocher ..... B65B 67/085 242/410
6,250,048 B1 * 6/2001 Linkiewicz ..... B29C 66/81457 156/497
6,481,184 B1 * 11/2002 Junker ..... B65B 9/213 53/134.1
2002/0177380 A1 * 11/2002 Forman ..... B29C 66/81431 383/906
2005/0172576 A1 * 8/2005 Matsunaga ..... B65B 51/303 53/410
2008/0041023 A1 * 2/2008 Tsuruta ..... B29C 66/0342 53/548
2009/0199519 A1 * 8/2009 Tsuruta ..... B65B 41/16 53/552
2009/0277140 A1 * 11/2009 Tsuruta ..... B65B 9/20 53/551
2010/0210439 A1 * 8/2010 Goto ..... B65B 61/18 493/200
2011/0023423 A1 * 2/2011 Iwasaki ..... B65B 57/00 53/510
2012/0085479 A1 * 4/2012 Goto ..... B65B 9/2028 156/538
2012/0159905 A1 * 6/2012 Tsuruta ..... B29C 66/81422 53/552
2012/0160927 A1 * 6/2012 Cerveny ..... A47J 31/40 239/24
2012/0210681 A1 * 8/2012 Hennissen ..... B65B 65/006 53/559
2013/0146178 A1 * 6/2013 Graffin ..... G01G 23/12 141/83
2014/0110426 A1 * 4/2014 Veltrop ..... B67D 3/0093 222/640
2017/0096248 A1 * 4/2017 Sanfilippo ..... B65B 61/28
2017/0101198 A1 * 4/2017 Cherney ..... B65B 51/26
2017/0129629 A1 * 5/2017 Zacche' ..... B65B 39/004
2018/0346159 A1 * 12/2018 Ichikawa ..... B29C 66/4312
2019/0135460 A1 * 5/2019 Dersch ..... B65B 59/04
2020/0017245 A1 1/2020 Tsuruta et al.
2020/0087009 A1 3/2020 Tsuruta et al.

FOREIGN PATENT DOCUMENTS

JP 5-85521 A 4/1993
JP 6-183418 A 7/1994
JP 11-198906 A 7/1999
JP 2005-280927 A 10/2005
JP 2005-313963 A 11/2005
JP 2008-100710 A 5/2008
JP 2011251759 A 12/2011
JP 2013116748 A 6/2013
JP 2015063329 A 4/2015
JP 2015071435 A 4/2015
JP 2015074507 A 4/2015
JP 2015217985 A 12/2015
JP 2017071442 A 4/2017
JP 2018203364 A 12/2018
JP 2019038582 A 3/2019
JP 2020055605 A 4/2020
WO 2011/001528 A1 1/2011
WO 2018/066029 A1 4/2018
WO 2018/225422 A1 12/2018
WO 2019/207672 A1 10/2019

OTHER PUBLICATIONS

Office Action dated Dec. 28, 2020, issued in counterpart CN Application No. 201880033407.0, with English Translation. (22 pages).

* cited by examiner

VERTICAL BAG-MAKING/FILLING/PACKAGING MACHINE, MANUFACTURING METHOD OF FILM PACKAGING BAG WITH CONTENT

TECHNICAL FIELD

The present invention relates to a vertical bag-making/filling/packaging machine which fills a content in a bag while weighing it. The present invention particularly relates to a vertical bag-making/filling/packaging machine which fills a liquid or a fluid in a pillow packaging bag.

BACKGROUND ART

Patent Literature 1 discloses a vertical bag-making/filling/packaging machine which fills a content while weighing (measuring a weight) in a so-called pillow packaging bag.

The pillow packaging bag is a pillow-shaped bag obtained by heat-sealing one sheet of film back to back so as to make a cylindrical shape (tubular shape) and then, by heat-sealing it in a width direction at a constant interval and by cutting it. The pillow packaging bag is also called a butt-seam sealing bag or a back-sealing bag and is often used for automatic packaging for foods.

This vertical bag-making/filling/packaging machine includes a bag-making guide for folding the film into a cylindrical shape and a load cell which supports the bag-making guide. The tubular film is suspended from the bag-making guide. Thus, the load cell can weigh the content input (filled) in the tubular film.

CITATION LIST

Patent Literature

Patent Literature 1: Japanese Patent Laid-Open No. 11-198906

SUMMARY OF INVENTION

Technical Problem

In the vertical bag-making/filling/packaging machine, when the content is to be filled in the tubular film suspended from the bag-making guide, swelling or expansion of the film is not always constant. Thus, weighing of the content by the load cell becomes unstable, and a weighing error occurs. This weighing error exceeds weighing accuracy required by a user (allowed error is within +10 g, for example). Therefore, the filled amount of the content cannot be made constant.

The present invention has an object to provide a vertical bag-making/filling/packaging machine which weighs a filled amount of a content with accuracy and can manufacture a film packaging bag excellent in quantitativity of the content.

Solution to Problem

A first aspect of a vertical bag-making/filling/packaging machine according to the present invention is characterized by including: a film supply portion which lets out a film from a roll; a film engaging portion which is engaged with the film and changes a conveying direction downward; a vertical seal portion which heat-seals side edges of the film to each other so as to make the film into a tubular shape; a film conveying portion which conveys the film downward; a film clamp which holds the film on the film engaging portion; a film tension releasing portion which loosens the film laid between the film supply portion and the film engaging portion; a filling portion which inputs a content to an interior of the film; a weighing portion which supports the film engaging portion and weighs the content; a lateral sealing portion which heat-seals the film in a width direction so as to make a bag body; and a cutter which cuts off the bag body from the film.

A second aspect of the vertical bag-making/filling/packaging machine according to the present invention is characterized in that, in the first aspect, the film engaging portion includes a bag-making guide which folds the film into a tubular shape.

A third aspect of the vertical bag-making/filling/packaging machine according to the present invention is characterized in that, in the first or second aspect, the film tension releasing portion includes: a first driven roller in contact with the film; a second driven roller disposed in parallel with the first driven roller; and a roller moving portion which detaches one or the both of the first driven roller and the second driven roller from the film.

A fourth aspect of the vertical bag-making/filling/packaging machine according to the present invention is characterized in that, in the third aspect, the first driven roller and the second driven roller are revolved.

A fifth aspect of the vertical bag-making/filling/packaging machine according to the present invention is characterized in that, in the third or fourth aspect, the roller moving portion is disposed on an outer surface side of the film.

A sixth aspect of the vertical bag-making/filling/packaging machine according to the present invention is characterized in that, in any one of the first to fifth aspects, the film clamp is coupled to the film engaging portion.

A seventh aspect of the vertical bag-making/filling/packaging machine according to the present invention is characterized in that, in any one of the first to sixth aspects, the film supply portion includes a second film clamp which holds the film and maintains a tension of the film when the film tension releasing portion is operated.

An eighth aspect of the vertical bag-making/filling/packaging machine according to the present invention is characterized in that, in the seventh aspect, the second film clamp includes a conveying roller pair which sandwiches the film.

A ninth aspect of the vertical bag-making/filling/packaging machine according to the present invention is characterized in that, in any one of the first to eighth aspects, the weighing portion includes a pair of load cells, and the film engaging portion is laid over the pair of load cells.

A tenth aspect of the vertical bag-making/filling/packaging machine according to the present invention is characterized in that, in any one of the first to ninth aspects, the film conveying portion is separated from the film engaging portion, and when the film tension releasing portion is operated, the film conveying portion is detached from the film.

An eleventh aspect of the vertical bag-making/filling/packaging machine according to the present invention is characterized in that, in any one of the first to tenth aspects, the vertical seal portion includes: a vertical heater separated from the film engaging portion; and a guide roller pair coupled to the film engaging portion and sandwiching side edges of the film above and below the vertical heater, and the vertical heater is detached from the film when the film tension releasing portion is operated.

A twelfth aspect of the vertical bag-making/filling/packaging machine according to the present invention is characterized in that, in any one of the first to eleventh aspects, the filling portion includes: a nozzle which discharges the content; a shutter which adjusts an opening degree of the nozzle; and a pump which transports the content toward the nozzle.

A thirteenth aspect of the vertical bag-making/filling/packaging machine according to the present invention is characterized in that, in any one of the first to twelfth aspects, it includes a pair of deaerating plates which is disposed immediately below the lateral sealing portion and regulates a thickness of the bag body when the lateral sealing portion is operated.

A fourteenth aspect of the vertical bag-making/filling/packaging machine according to the present invention is characterized in that, in any one of the first to thirteenth aspects, it includes a bag supporting portion disposed below the lateral sealing portion and supporting a bottom of the bag body when the lateral sealing portion is operated, and the bag supporting portion conveys the bag body toward a bag-body carrying-out portion after the cutter is operated.

A fifteenth aspect of the vertical bag-making/filling/packaging machine according to the present invention is characterized in that, in the fourteenth aspect, the bag supporting portion includes a conveyor and swings the conveyor downward so as to slide the bag body down.

A sixteenth aspect of the vertical bag-making/filling/packaging machine according to the present invention is characterized in that, in the fifteenth aspect, the bag-body carrying-out portion conveys an accommodating box below the bag supporting portion, and the bag supporting portion swings the conveyor so as to open an upper lid of the accommodating box widely.

A first aspect of a manufacturing method of the film packaging bag with contents according to the present invention is characterized by having: a film engaging step in which a conveying direction of a film let out from a roll is changed downward via a film engaging portion; a film conveying step in which the film is conveyed downward; a vertical sealing step in which side edges of the film are heat-sealed to each other so as to form a tubular shape; a film tension releasing step in which a tension of the film laid toward the film engaging portion is released; a filling step in which the content is input to an interior of the film, a weighing step in which the film engaging portion is supported and the content is weighed; a lateral sealing step in which the film is heat-sealed in a lateral direction so as to make a bag body; and a bag-body cutting-off step in which the bag body is cut off from the film.

A second aspect of the manufacturing method of the film packaging bag with contents according to the present invention is characterized in that the film tension releasing step in the first aspect has: a film clamping step in which the film is held on the film engaging portion; and a film loosening step in which the film laid toward the film engaging portion is loosened.

A third aspect of the manufacturing method of the film packaging bag with contents according to the present invention is characterized in that, in the second aspect, the film tension releasing step has a retreating step in which the film conveying portion for conveying the film is detached from the film.

A fourth aspect of the manufacturing method of the film packaging bag with contents according to the present invention is characterized in that, in any one of the first to third aspects, it includes a boxing step in which, after the bag body is supported by the conveyor, the conveyor is swung downward so as to convey the bag body toward the accommodating box.

A fifth aspect of the manufacturing method of the film packaging bag with contents according to the present invention is characterized in that, in any one of the first to fourth aspects, in the filling step, an input amount of the content is suppressed when a weighing result obtained in the weighing step gets closer to a target value.

Advantageous Effects of Invention

According to the present invention, the vertical bag-making/filling/packaging machine releases (loosens) the tension applied to the film by the film tension releasing portion when the content is to be weighed by the weighing portion. Thus, the weighing portion can accurately weigh (weight measurement) the content filled in the film without being influenced by the tension of the film. Therefore, the vertical bag-making/filling/packaging machine can continuously manufacture the film packaging bags excellent in quantitativity of a content X.

DESCRIPTION OF EMBODIMENTS

A vertical bag-making/filling/packaging machine 1 and a manufacturing method of a film packaging bag G with contents according to an embodiment of the present invention will be described below.

Vertical Bag-Making/Filling/Packaging Machine 1

Figure 1:
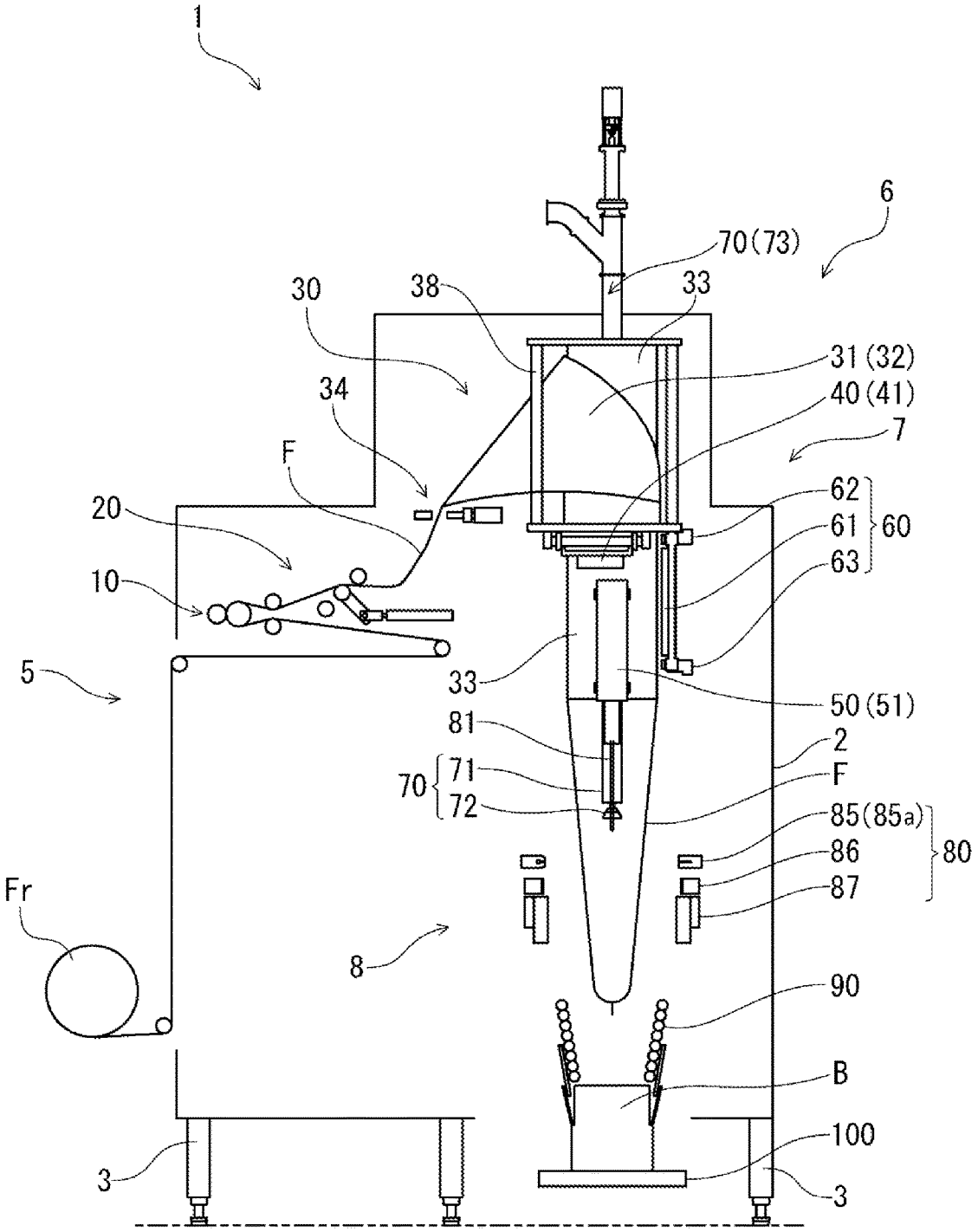
FIG. 1 is a side view of a vertical bag-making/filling/packaging machine 1 according to an embodiment of the present invention.
Figure 2:
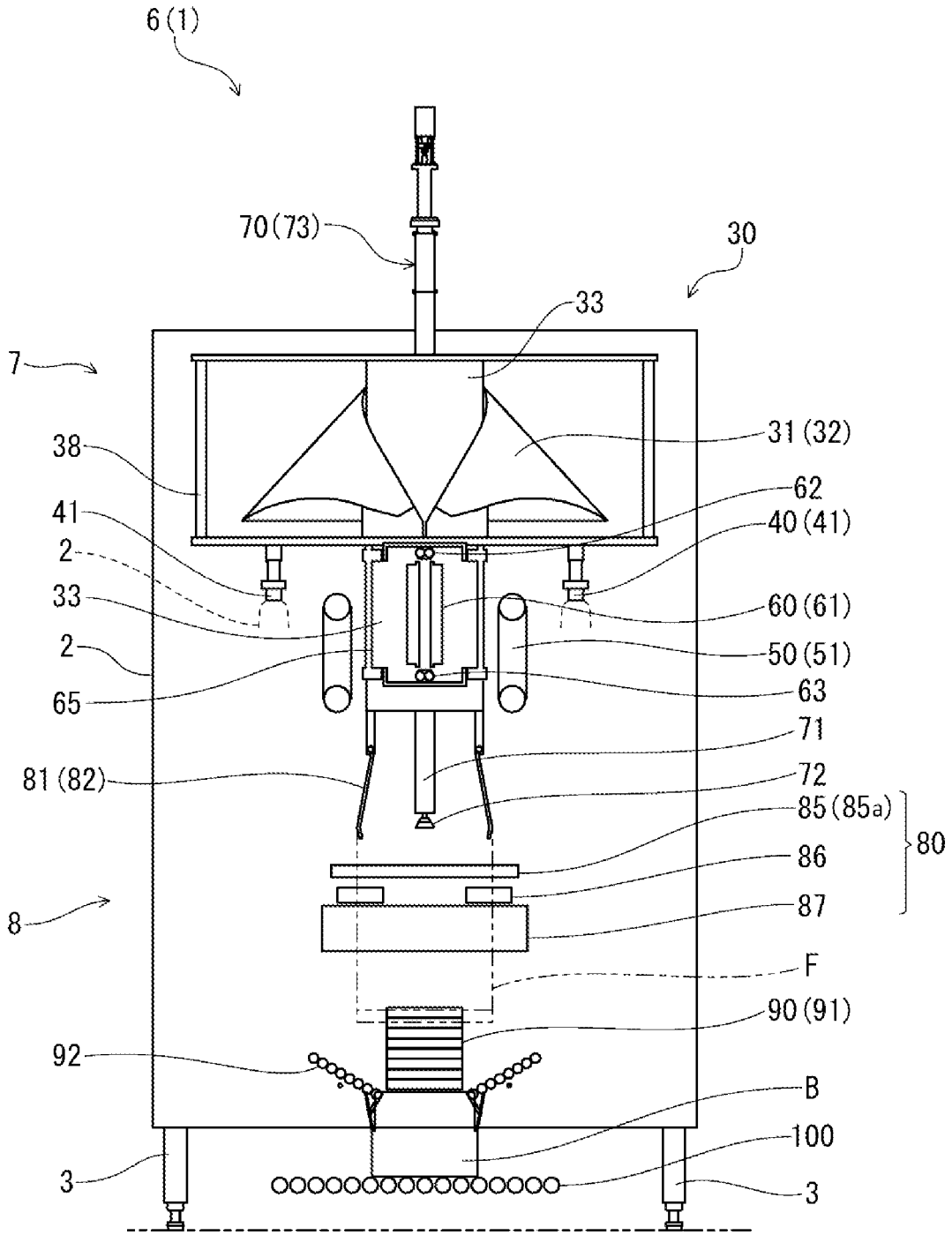
FIG. 2 is a front view of the vertical bag-making/filling/packaging machine 1 (bag-making/filling/packaging portion 6) according to the embodiment of the present invention.

FIG. 1 is a side view of a vertical bag-making/filling/packaging machine 1. FIG. 2 is a front view of the vertical bag-making/filling/packaging machine 1 (bag-making/filling/packaging portion 6).

The vertical bag-making/filling/packaging machine 1 forms a pillow-type film packaging bag (bag body) G from a lengthy film F and fills a content X in this film packaging bag G at the same time.

For the film F, a laminate film in which high-strength film such as nylon and polyester are laminated is used. Those in which a plurality of films is laminated in a state movable with respect to each other may also be used. The film packaging bag G with high mechanical strength is manufactured.

The content X is liquid or paste-state (semi-solid) beverages, foods and the like. Specifically, the content X is liquids such as drinking water and liquid egg, or fluids such as margarine, shortening and chocolate.

The vertical bag-making/filling/packaging machine 1 fills the content X while intermittently conveying the film F downward under control of a control portion (not shown). The vertical bag-making/filling/packaging machine 1 fills the content X substantially fully so that air is not left in the film packaging bag G as much as possible.

The vertical bag-making/filling/packaging machine 1 fills the content X in the film packaging bag G while weighing it. The vertical bag-making/filling/packaging machine 1 makes a weight (a filled amount, an input amount) of the content X constant with accuracy. The vertical bag-making/filling/packaging machine 1 continuously manufactures the film packaging bag G excellent in quantitativity of the content.

A longitudinal direction of the film F is also called a conveying direction. A width direction of the film F is also called a lateral direction. A direction in which the film F (film packaging bag G) is expanded is also called a thickness direction.

The longitudinal direction of the film F in the vertical bag-making/filling/packaging portion 6 is also called a perpendicular direction, an upper-and-lower direction or a vertical direction. The lateral direction of the film F in the bag-making/filling/packaging portion 6 is also called a right-and-left direction. The thickness direction of the film F in the bag-making/filling/packaging portion 6 is called a front-and-rear direction.

As illustrated in FIGS. 1 and 2, the vertical bag-making/filling/packaging machine 1 includes a film supply portion 5 and the bag-making/filling/packaging portion 6.

The film supply portion 5 is disposed on a rear, while the bag-making/filling/packaging portion 6 is disposed on a front. The film supply portion 5 and the bag-making/filling/packaging portion 6 are disposed inside an apparatus frame 2. The apparatus frame 2 is installed on a floor surface through a leg portion 3.

Film Supply Portion 5

The film supply portion 5 supplies the film F toward the bag-making/filling/packaging portion 6.

The film supply portion 5 includes a plurality of driven rollers, a conveying roller pair 10, a film tension releasing portion 20 and the like.

The film supply portion 5 pivotally supports the film F (roll film Fr) wound in a roll state. The film supply portion 5 lets out the film F from the roll film Fr and passes it through the plurality of rollers and the like. The film supply portion 5 feeds out the film F with a constant tension applied so that it is not loosened or meandered.

In the film supply portion 5, the film tension releasing portion 20 is disposed on a lowermost stream in the conveying direction of the film F. The conveying roller pair 10 is disposed immediately on an upstream of the film tension releasing portion 20.

Conveying Roller Pair 10

The conveying roller pair (second film clamp) 10 is made of a driving roller 11 and a driven roller 12. The driving roller 11 and the driven roller 12 are disposed in parallel in close contact with each other. The driving roller 11 is rotated/driven by a driving motor 13.

The conveying roller pair 10 feeds out the film F while sandwiching the film F at all times by the driving roller 11 and the driven roller 12.

Film Tension Releasing Portion 20

Figure 3A:
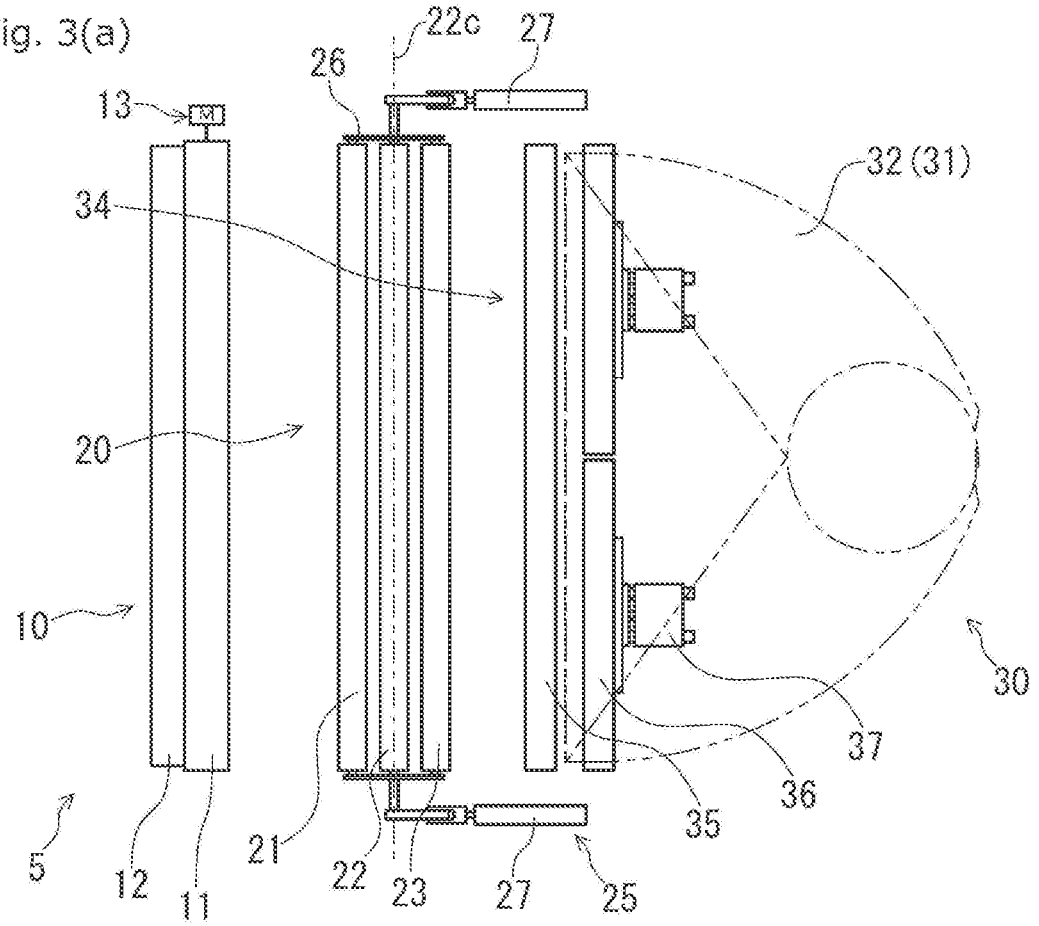
FIGS. 3(*a*) and 3(*b*) are views illustrating a film tension releasing portion 20, in which FIG. 3(*a*) is a plan view and FIG. 3(*b*) is a side view.
Figure 3B:
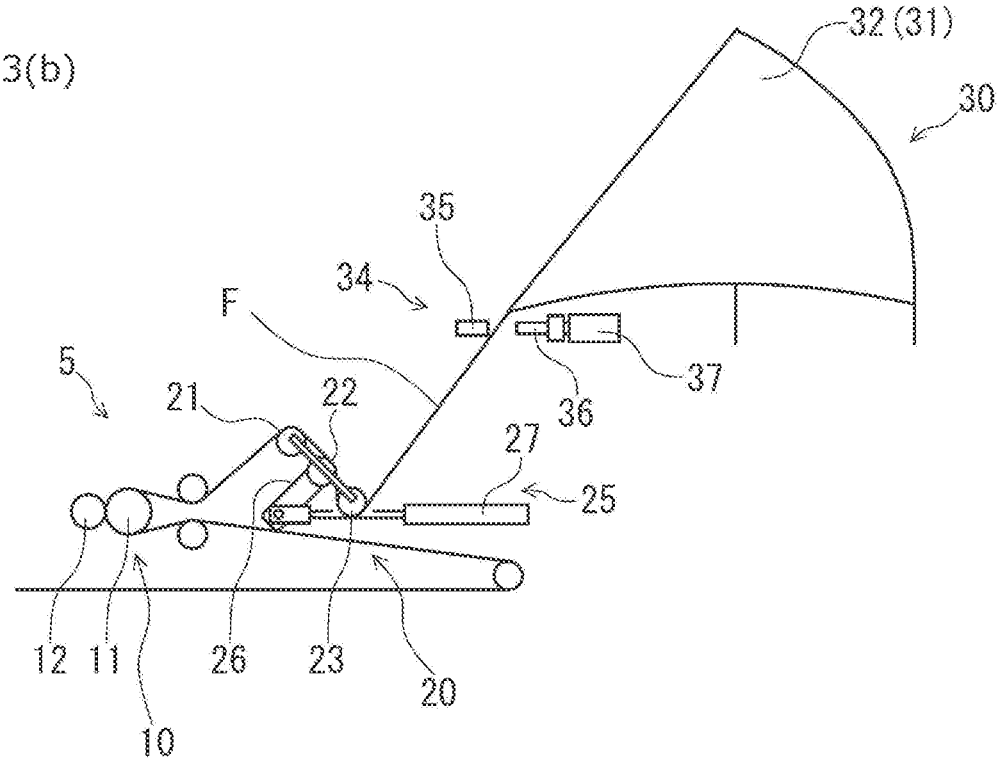

FIGS. 3(*a*) and 3(*b*) are views illustrating the film tension releasing portion 20, in which FIG. 3(*a*) is a plan view and FIG. 3(*b*) is a side view.

The film tension releasing portion 20 includes three driven rollers 21, 22 and 23 and a roller moving portion 25 for moving the driven rollers 21, 22, and 23.

The driven rollers 21, 22, and 23 are disposed separately from each other in parallel. The driven rollers 21, 22, and 23 are disposed at an equal interval, and the film F is laid over them.

The driven rollers (first driven rollers) 21 and 22 are in close contact with an outer surface of the film F. The driven roller (second driven roller) 23 is in close contact with an inner surface of the film F. The outer surface of the film F becomes an outer surface of the film packaging bag G, and the inner surface of the film F is an inner surface of the film packaging bag G.

The roller moving portion 25 brings the driven rollers 21, 22, and 23 into close contact with the film F or detaches them from the film F. The roller moving portion 25 includes a supporting member 26 which supports the driven rollers 21, 22, and 23, capable of being driven/rotating, and an air cylinder 27 which drives the supporting member 26.

The supporting member 26 pivotally supports the driven rollers 21, 22, and 23. The supporting member 26 is supported rotatably around a rotating shaft 22*c* of the driven roller 22 with respect to the apparatus frame 2.

The air cylinder 27 is disposed on the outer surface side of the film F and is connected to the supporting member 26. The air cylinder 27 gives a rotating force around the rotating shaft 22*c* to the supporting member 26. That is, the air cylinder 27 rotates (revolves) the driven rollers 21, 23 around the rotating shaft 22*c*.

When the driven rollers 21, 23 are rotated around the rotating shaft 22*c*, the driven rollers 21, 23 are brought into close contact with the film F or are detached therefrom. As a result, the roller moving portion 25 applies a tension to the film F or releases the tension.

The film F is fed out obliquely upward from the film supply portion 5. The film F is conveyed toward an upper end of the bag-making/filling/packaging portion 6 (a bag-making guide 31 which will be described later) from the film supply portion 5. The conveying direction of the film F is changed to a downward direction at the upper end of the bag-making/filling/packaging portion 6.

Bag-Making/Filling/Packaging Portion 6

The bag-making/filling/packaging portion 6 forms the film packaging bag G on the film F while feeding the film F downward (in a vertical direction). The bag-making/filling/packaging portion 6 fills the content X in the film packaging bag G while weighing it. The bag-making/filling/packaging portion 6 separates the film packaging bag G from the film F and continuously manufactures the film packaging bag G in which the content X is filled (film packaging bag G with contents).

The bag-making/filling/packaging portion 6 includes a bag making portion 7, a filling/packaging portion 8 and the like.

The bag making portion 7 is disposed above, while the filling/packaging portion 8 is disposed below. The film F is fed to the filling/packaging portion 8 via the bag making portion 7. The bag making portion 7 forms the tubular film F, and the filling/packaging portion 8 manufactures the film packaging bag G in which the content X is filled.

Bag Making Portion 7

The bag making portion 7 forms the film F into the tubular shape while feeding the film F in the vertical direction (downward direction). The bag making portion 7 includes a bag-making guide unit 30, a weighing portion 40, a film conveying portion 50, and a vertical sealing portion 60.

Bag-Making Guide Unit 30

The bag-making guide unit 30 includes the bag-making guide 31, a film clamp 34, and a support frame 38.

The bag-making guide unit 30 folds the film F into the tubular shape. Moreover, the bag-making guide unit 30 holds the tubular film F in a state suspended to the downward direction.

The bag-making guide (film engaging portion) 31 is brought into close contact (engaged) with the film F supplied from the film supply portion 5 and changes the conveying direction from the obliquely upward direction to the downward direction while folding the film F into the tubular shape. The bag-making guide 31 includes a sailor suit-like 32 and a pipe portion 33.

The sailor suit-like 32 is a member in which a thin plate made of stainless steel is folded like a collar of a sailor uniform, and an upstream side is formed into a flat plate shape, while a downstream side into a cylindrical shape. The downstream side of the sailor suit-like 32 extends in the upper-and-lower direction.

The pipe portion 33 is a cylindrical body made of stainless steel and is fitted into the downstream side (a cylindrical part) of the sailor suit-like 32. The pipe portion 33 is disposed along the upper-and-lower direction, and a slight gap is provided between the pipe portion 33 and the sailor suit-like 32. The pipe portion 33 has an upper end protruding slightly above the sailor suit-like 32 and a lower end extending below the sailor suit-like 32.

The film F is conveyed along the upper surface of the sailor suit-like 32 and is inserted into the gap between the sailor suit-like 32 and the pipe portion 33. The film F is folded into the tubular shape via the gap between the sailor suit-like 32 and the pipe portion 33. The tubular film F is conveyed downward along the outer peripheral surface of the pipe portion 33.

The film clamp 34 is disposed on an upstream end of the sailor suit-like 32. The film clamp 34 includes a fixed bar 35, a movable bar 36, and an air cylinder 37.

The fixed bar 35 and the movable bar 36 are disposed separately in parallel along the lateral direction on the slightly upstream side with respect to the sailor suit-like 32. The fixed bar 35 is disposed in a rear direction, while the movable bar 36 in a front direction.

The film F is inserted between the fixed bar 35 and the movable bar 36. The fixed bar 35 is fixed slightly separately from the inner surface of the film F. The movable bar 36 is coupled to the air cylinder 37 slightly separately from the outer surface of the film F.

The air cylinder 37 presses the movable bar 36 so as to bring it into close contact with the fixed bar 35 or detaches it from the fixed bar 35.

The film clamp 34 can sandwich the film F by the fixed bar 35 and the movable bar 36 by driving the air cylinder 37.

The support frame 38 is a member which supports only the bag-making guide 31 and the film clamp 34. The support frame 38 is formed having a cuboid shape.

The support frame 38 is independently provided separately from the apparatus frame 2. The support frame 38 is disposed above (upstream side of) the bag-making/filling/packaging portion 6. The support frame 38 is supported by the apparatus frame 2 through the weighing portion 40.

A lower end of the sailor suit-like 32 and an upper end of the pipe portion 33 are connected to the support frame 38. The pipe portion 33 extends below the support frame 38.

Weighing Portion 40

The weighing portion 40 is for measuring a weight change of the bag-making guide unit 30 and includes a pair of load cells 41. The load cells 41 are fixed to the apparatus frame 2 and support the support frame 38.

The load cells 41 are disposed on outer sides (left side, right side) in the width direction of the bag-making/filling/packaging portion 6, respectively. The support frame 38 is disposed (placed) across the pair of load cells 41.

Since the weighing portion 40 supports the support frame 38, the weight change of the film F suspended from the bag-making guide 31 can be measured. That is, the weighing portion 40 weighs (weight measurement) the content X input into the tubular film F.

Film Conveying Portion 50

The film conveying portion 50 intermittently conveys the film F downward at a predetermined pitch. The film conveying portion 50 is disposed on both side surfaces of the pipe portion 33 below the sailor suit-like 32.

The film conveying portion 50 includes two rotating belts 51 which feed the film F downward. The rotating belts 51 are disposed on the both side surfaces (both right and left sides) of the pipe portion 33, respectively, and extend in the vertical direction. The two rotating belts 51 are coupled to the apparatus frame 2 through a rotating belt driving portion (not shown).

The rotating belts 51 are moved inward in the width direction (get closer to each other) and are brought into close contact with the pipe portion 33. As a result, the film F is sandwiched by the rotating belts 51 and the pipe portion 33. The film conveying portion 50 intermittently rotates the two rotating belts 51 and conveys the film F downward. The conveyed amount (1 pitch) of the film F by the film conveying portion 50 matches a length of the film packaging bag G in the vertical direction.

The rotating belts 51 can be moved outward in the width direction (separated from each other) so as to be detached from the pipe portion 33 and the film F.

Vertical Sealing Portion 60

The vertical sealing portion 60 is disposed on a front surface of the pipe portion 33 below the sailor suit-like 32. The vertical sealing portion 60 heat-seals (heat-fuses) the side edges of the film F each other along the vertical direction, the film F having been folded into the tubular shape via the sailor suit-like 32. The vertical sealing portion 60 includes a vertical heater 61 and the guide roller pairs 62, 63.

The vertical heater 61 is made of a pair of heater bars extending in the vertical direction and is coupled to the apparatus frame 2 through a vertical heater bar driving portion (not shown).

When the vertical heater 61 heat-seals the side edges of the film F to each other along the vertical direction, a vertical seal T (not shown) is formed in the film F, and the film F becomes a complete tubular shape.

The vertical seal T is also called a back-seal. A length of the vertical heater 61 (vertical seal T) matches the length of the film packaging bag Gin the vertical direction.

When the vertical heater 61 (the pair of heater bars) heat-seals the film F, it is moved inward in the width direction and sandwiches the film F. When the vertical heater 61 (the pair of heater bars) does not heat-seal the film F, it moves outward in the width direction so as to be detached from the film F.

The guide roller pairs 62, 63 are made of a pair of driven rollers, respectively, and sandwiches the side edges of the film F in the overlapped state. The guide roller pairs 62, 63 sandwich the side edges of the film F at all times.

The guide roller pair 62 is disposed immediately above the vertical heater 61, and the guide roller pair 63 is disposed immediately below the vertical heater 61. The guide roller pair 62 sandwiches both of the side edges of the film F immediately before heat-sealing by the two driven rollers. The guide roller pair 63 sandwiches the both side edges (vertical seal T) of the film F immediately after the heat seal by the two driven rollers.

The guide roller pairs 62, 63 are fixed rotatably with respect to a roller support frame 65 coupled to the support frame 38. The roller support frame 65 is formed having a rectangular shape and is disposed on the front surface of the pipe portion 33. The roller support frame 65 extends downward from the bottom surface of the support frame 38 and surrounds the vertical heater 61.

That is, the guide roller pairs 62, 63 are coupled to the support frame 38, unlike the vertical heater 61.

Filling/Packaging Portion 8

The filling/packaging portion 8 fills the content X inside the tubular film F and further manufactures the film packaging bag G in which the content X is filled. The filling/packaging portion 8 includes a filling portion 70, a lateral sealing portion 80, a bag supporting portion 90 and the like. A conveying conveyor 100 is attached to the filling/packaging portion 8.

Filling Portion 70

The filling portion 70 inputs (fills) the content X in a liquid or paste state inside the tubular film F. The filling portion 70 includes a nozzle 71, a shutter 72, and a liquid-feeding pump 73.

The nozzle 71 is disposed along a center axis of the pipe portion 33. The nozzle 71 is inserted into the pipe portion 33 and extends downward. The nozzle 71 protrudes upward with respect to the pipe portion 33 and is fixed to the apparatus frame 2. The nozzle 71 discharges drinking water, for example, to the downward direction.

The shutter 72 is built in the lower end of the nozzle 71 and adjusts an opening degree of the nozzle 71. That is, the shutter 72 adjusts the discharge amount of the content X.

The liquid-feeding pump 73 transports the content X toward an upper part of the nozzle 71.

Lateral Sealing Portion 80

The lateral sealing portion 80 is disposed below the lower end of the nozzle 71. The lateral sealing portion 80 heat-seals (heat-fuses) the tubular film F across the lateral direction and forms the film packaging bag G. The lateral sealing portion 80 includes a flattening mechanism 81, a lateral heater 85, a wrinkle removing portion 86, and a deaerating plate 87.

The flattening mechanism 81 is a member for flattening (making flat) the tubular film F in the lateral direction. The flattening mechanism 81 includes a pair of guide rods 82 and an air cylinder 83 which swings the guide rods 82.

The guide rods 82 are a pair of rods further extending downward from the lower ends of the both side surfaces (left surface, right surface) of the pipe portion 33. The guide rod 82 has its lower end at substantially the same height as the lower end of the nozzle 71 and is disposed outside in the lateral direction so as to be capable of swing.

The air cylinder 83 presses the upper end of the guide rod 82 and swings the guide rod 82 outward in the lateral direction.

The flattening mechanism 81 can swing the pair of guide rods outward in the lateral direction so as to laterally expand the tubular film F from inside and flatten it.

The lateral heater 85 extends in the lateral direction immediately below the nozzle 71 and the guide rods 82. The lateral heater 85 is made of a pair of heater bars disposed with film F therebetween. The lateral heater 85 is coupled to the apparatus frame 2 through the lateral heater bar driving portion (not shown).

When the lateral heater 85 heat-seals the tubular film F across the lateral direction, a lateral seal Y is formed in the film F. Moreover, the tubular film F becomes the film packaging bag G.

When the lateral heater 85 (a pair of heater bars) heat-seals the film F, it is moved inward in the front-and-rear direction (getting closer to each other) and sandwiches the film F. When the lateral heater 85 (the pair of heater bars) does not heat-seal the film F, it moves outward in the front-and-rear direction (separated from each other) so as to be detached from the film F.

A cutter 85*a* for cutting the film F (lateral seal Y) across the lateral direction is provided on one of the heater bars.

The wrinkle removing portion 86 extends in the lateral direction immediately below the lateral heater 85. The wrinkle removing portion 86 is made of a pair of two sets (four) clamp bars disposed outside in the lateral direction with the film F (film packaging bag G) therebetween. The wrinkle removing portion 86 is coupled to the apparatus frame 2 through a wrinkle removing plate driving portion (not shown).

The wrinkle removing portion 86 grasps both right and left sides of the film F, respectively, before the lateral heater 85 heat-seals the film F.

When the lateral heater 85 heat-seals the film F, since the wrinkle removing portion 86 grasps the outer sides of the film F in the width direction, a wrinkle hardly occurs in the lateral seal Y.

When the wrinkle removing portion 86 (pair of clamp bars) grasps the film F, it moves inward in the front-and-rear direction so as to sandwich the film F. When the wrinkle removing portion 86 (pair of clamp bars) does not grasp the film F, it moves outward in the front-and-rear direction so as to be detached from the film F.

The deaerating plate 87 extends in the lateral direction immediately below the wrinkle removing portion 86. The deaerating plate 87 is made of a pair of flat plates disposed with the film F (film packaging bag G) therebetween. The deaerating plate 87 is coupled to the apparatus frame 2 through a deaerating plate driving portion (not shown).

The deaerating plate 87 presses the film F in the front-and-rear direction before the lateral heater 85 heat-seals the film F. The deaerating plate 87 regulates the thickness of the film F (film packaging bag G). As a result, the content X filled in the film F is raised to immediately below the wrinkle removing portion 86. That is, the deaerating plate 87 pushes out air upward from the film F (film packaging bag G).

When the deaerating plate 87 (pair of flat plates) presses the film F, it moves inward in the front-and-rear direction and gets close to each other with the film F therebetween. When the deaerating plate 87 (pair of flat plates) does not press the film F, it moves outward in the front-and-rear direction so as to be detached from the film F.

Bag Supporting Portion 90

The bag supporting portion 90 is disposed immediately below the deaerating plate 87. The bag supporting portion 90 supports the bottom of the film packaging bag G when the film packaging bag G formed on the lower end of the film F is separated. The bag supporting portion 90 cuts the film packaging bag G off from the film F to slide it down toward a cardboard box B disposed immediately below.

The bag supporting portion 90 is coupled to the apparatus frame 2 through the bag supporting driving portion (not shown).

The bag supporting portion 90 is made of a pair of two sets (four) of roller conveyors 91, 92 and is disposed so as to surround the film F (film packaging bag G) from front and rear and right and left.

The roller conveyors 91, 92 are a plurality of driven rollers disposed in parallel and in a flat-plate state. The pair of roller conveyors 91 is disposed in the front-and-rear direction with the film F therebetween. The pair of roller conveyors 92 is disposed in the right-and-left direction with the film F therebetween.

The roller conveyors 91, 92 are capable of swing in the upper-and-lower direction and take a substantially horizontal attitude or a substantially perpendicular attitude.

When the roller conveyor pair 91 is swung inward in the front-and-rear direction (upward direction) so as to get closer to each other, it forms a shallow V-shape when seen from the side. As a result, the roller conveyor pair 91 supports the bottom of the film packaging bag G.

When the roller conveyor pair 91 is swung in the front-and-rear direction (downward direction) so as to be separated from each other, a space into which the film packaging bag G falls off is formed. As a result, the roller conveyor pair 91 slides the film packaging bag G downward.

The roller conveyor pair 92 is disposed with the roller conveyor pair 91 therebetween. When the roller conveyor pair 92 is swung inward in the width (upward direction) so as to get closer to each other, it forms a linear shape when seen from the front. As a result, the roller conveyor pair 92 supports the bottom of the film packaging bag G.

When the roller conveyor pair 92 is swung outward in the width direction (downward direction) so as to be separated from each other, a space through which the film packaging bag G falls off is formed. As a result, the roller conveyor pair 92 slides the film packaging bag G downward.

Conveying Conveyor 100

The conveying conveyor (bag-body carrying-out portion) 100 is disposed immediately below the filling/packaging portion 8. The conveying conveyor 100 is laid across a space between the leg portions 3 of the bag-making/filling/packaging portion 6 on an installation surface (floor surface) of the bag-making/filling/packaging portion 6.

The conveying conveyor 100 is a plurality of driven rollers disposed in parallel and in a flat-plate state and conveys (carries in/carries out) the cardboard box B toward immediately below the filling/packaging portion 8.

The cardboard box (accommodating box) B is a box body accommodating the film packaging bag G, and a 0201 type (JIS Z 1507), for example, is used. The cardboard box B is carried in (disposed) immediately below the filling/packaging portion 8 in a state with an upper lid open (in a state where an outer flap and an inner flap are upright perpendicularly).

Manufacturing Method of Film Packaging Bag G with Contents

Subsequently, a step of manufacturing the film packaging bag G with contents by using the vertical bag-making/filling/packaging machine 1 will be described.

The step of manufacturing the film packaging bag G with contents is performed in order of a preparation step S0, a film conveying step S1, a film tension releasing step S2, a content filling/weighing step S3, a lateral sealing step S4, a bag-body cutting-off step S5, and a boxing step S6.

Preparation Step S0

Figure 4A:
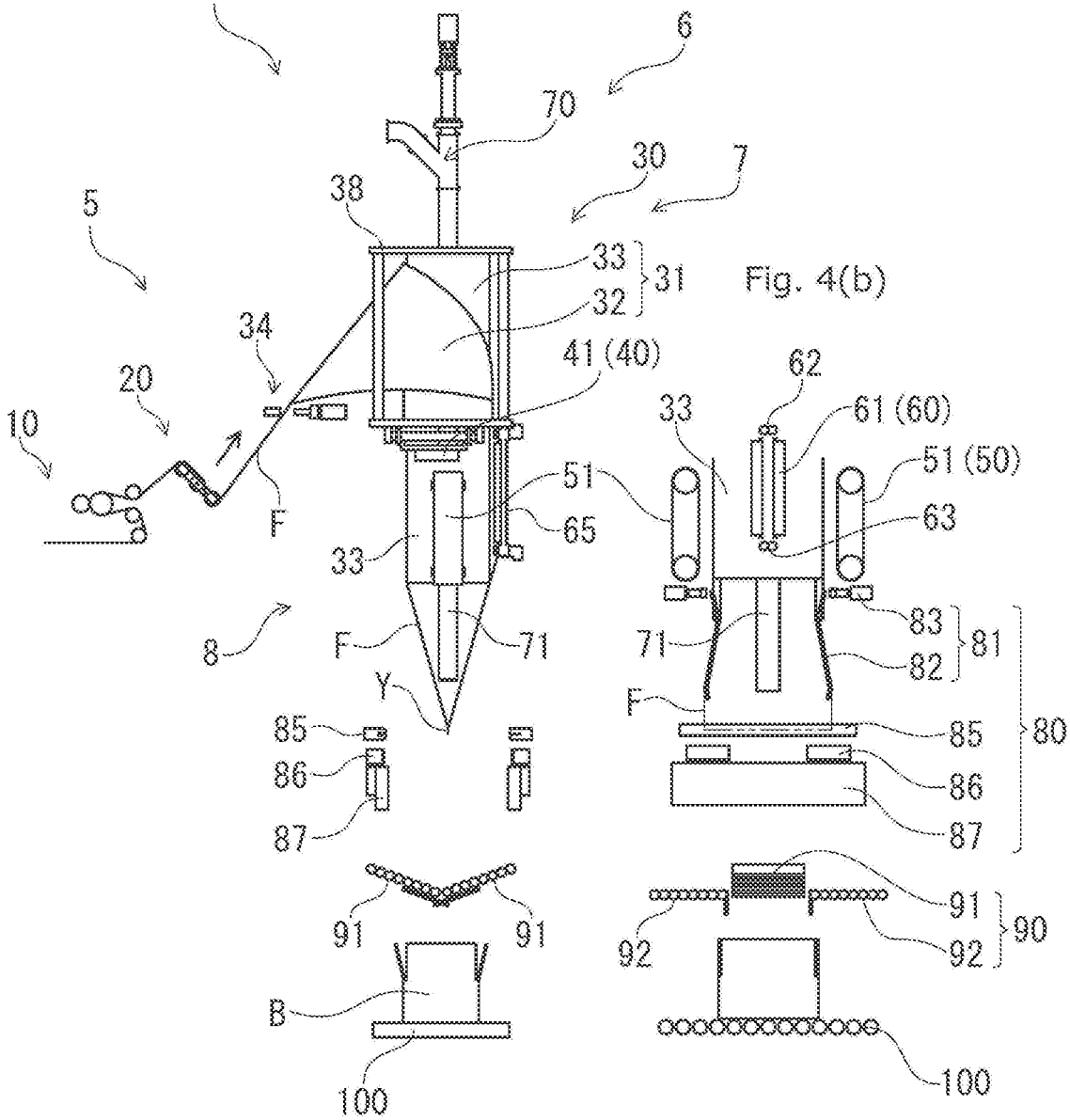
FIGS. 4(*a*) and 4(*b*) are views illustrating a preparation step of a manufacturing method of a film packaging bag G with contents, in which FIG. 4(*a*) is a side view and FIG. 4(*b*) is a front view.

FIGS. 4(*a*) and 4(*b*) are views illustrating a preparation step of the manufacturing method of the film packaging bag G with contents, in which FIG. 4(*a*) is a side view and FIG. 4(*b*) is a front view.

The preparation step is a step in which the film F is folded and sealed into a tubular shape and is further sealed at a lower end (distal end) so as to be a bag shape.

Film Engaging Step S0*a*

First, the film supply portion 5 lets out the film F from the roll film Fr (see FIG. 1). Then, the film F is folded into the tubular shape via the bag-making guide 31 (engaged) and fed downward.

The film engaging step S0*a* is continued at all times during the subsequent steps.

Vertical Sealing Step S0*b*

Subsequently, the vertical sealing portion 60 heat-seals the side edges of the film F to each other so as to make the film F into a complete tubular shape (the vertical seal T is formed). When the vertical seal T is formed, the vertical sealing portion 60 is detached from the film F. Then, the film F is further fed downward.

Lateral Sealing Step S0*c*

Subsequently, as illustrated in FIGS. 4(*a*) and 4(*b*), the film F is heat-sealed in the lateral direction by the lateral sealing portion 80, and the lower end is sealed (the lateral seal Y is formed). When the lateral seal Y is formed, the lateral sealing portion 80 is detached from the film F.

Film Conveying Step S1

Figure 5A:
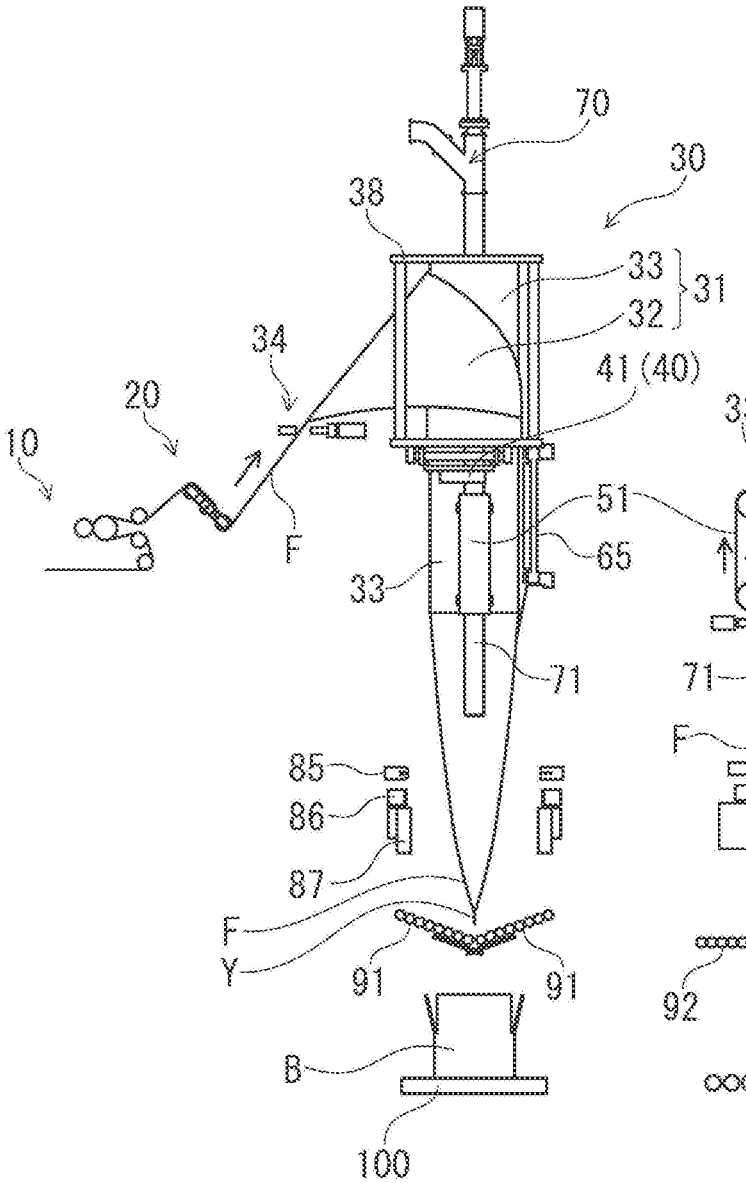
FIGS. 5(*a*) and 5(*b*) are views illustrating a film conveying step S1 of the manufacturing method of the film packaging bag G with contents, in which FIG. 5(*a*) is a side view and FIG. 5(*b*) is a front view.
Figure 5B:
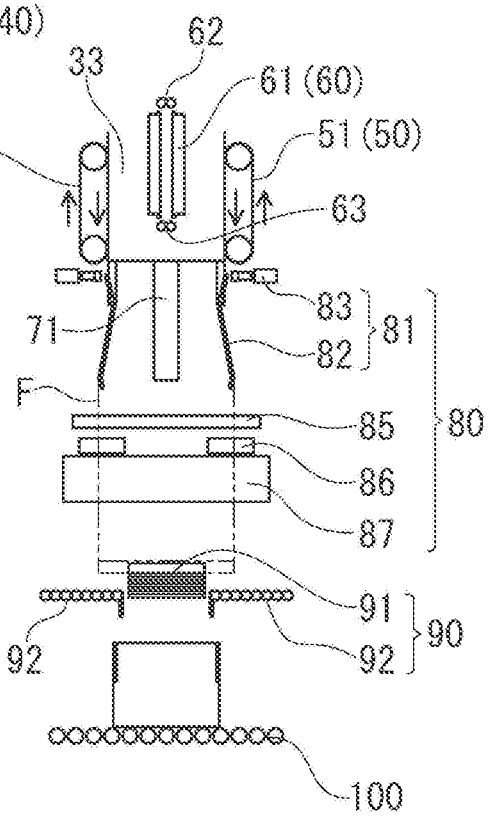

FIGS. 5(*a*) and 5(*b*) are views illustrating the film conveying step S1 of the manufacturing method of the film packaging bag G with contents, in which FIG. 5(*a*) is a side view and FIG. 5(*b*) is a front view.

The film conveying step S1 conveys the film F to a predetermined position in preparation for the supply of the content X into the film F.

As illustrated in FIGS. 5(*a*) and 5(*b*), the film conveying portion 50 feeds out the film F downward by intermittently rotating the two rotating belts 51. At the same time, the conveying roller pair 10 is supportively operated. The conveying roller pair 10 rotates/drives the driving roller 11 by the driving motor 13 and lets out the film F from the roll film Fr. When the film F is conveyed, a tension (tensile force) is generated in the film F.

As illustrated in FIGS. 5(*a*) and 5(*b*), in the bag-making/filling/packaging portion 6, the film F is fed out downward with a length of 1 pitch. The 1 pitch is a length of the film packaging bag G in the vertical direction.

Film Tension Releasing Step S2

Figure 6A:
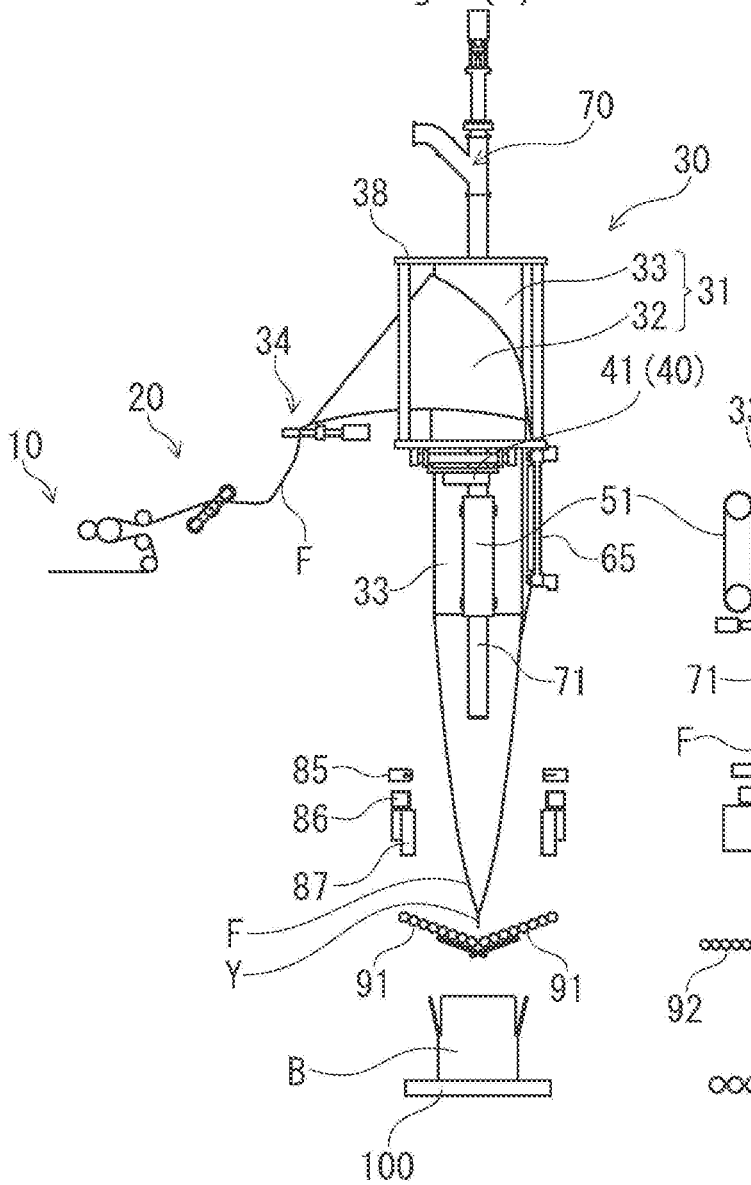
FIGS. 6(*a*) and 6(*b*) are side views illustrating a film tension releasing step S2 of the manufacturing method of the film packaging bag G with contents.
Figure 6B:
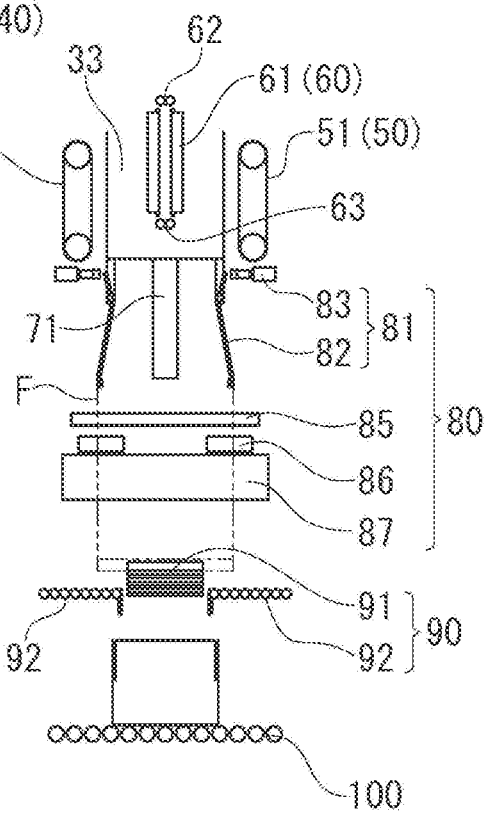

FIGS. 6(*a*) and 6(*b*) are side views illustrating the film tension releasing step S2 of the manufacturing method of the film packaging bag G with contents.

Figure 7A:
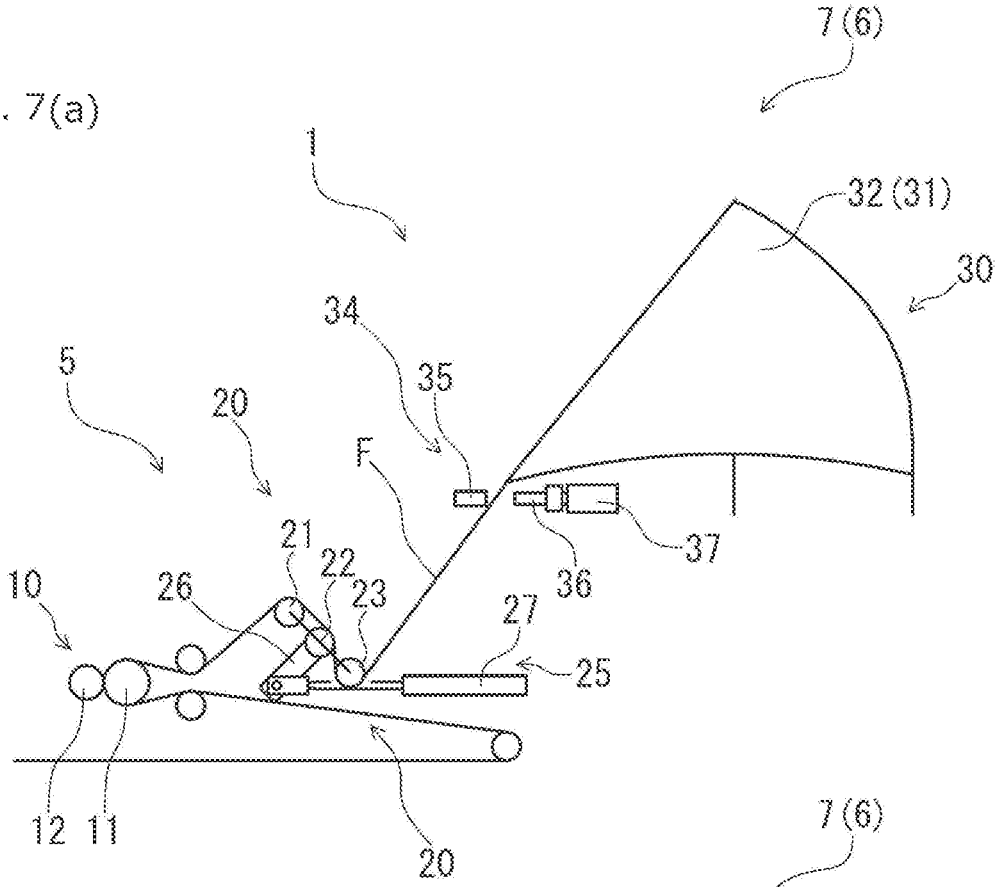
FIGS. 7(*a*) and 7(*b*) are enlarged side views illustrating the film tension releasing step S2 of the manufacturing method of the film packaging bag G with contents, in which FIG. 7(*a*) illustrates a state before tension release and FIG. 7(*b*) illustrates a state after the tension release.
Figure 7B:
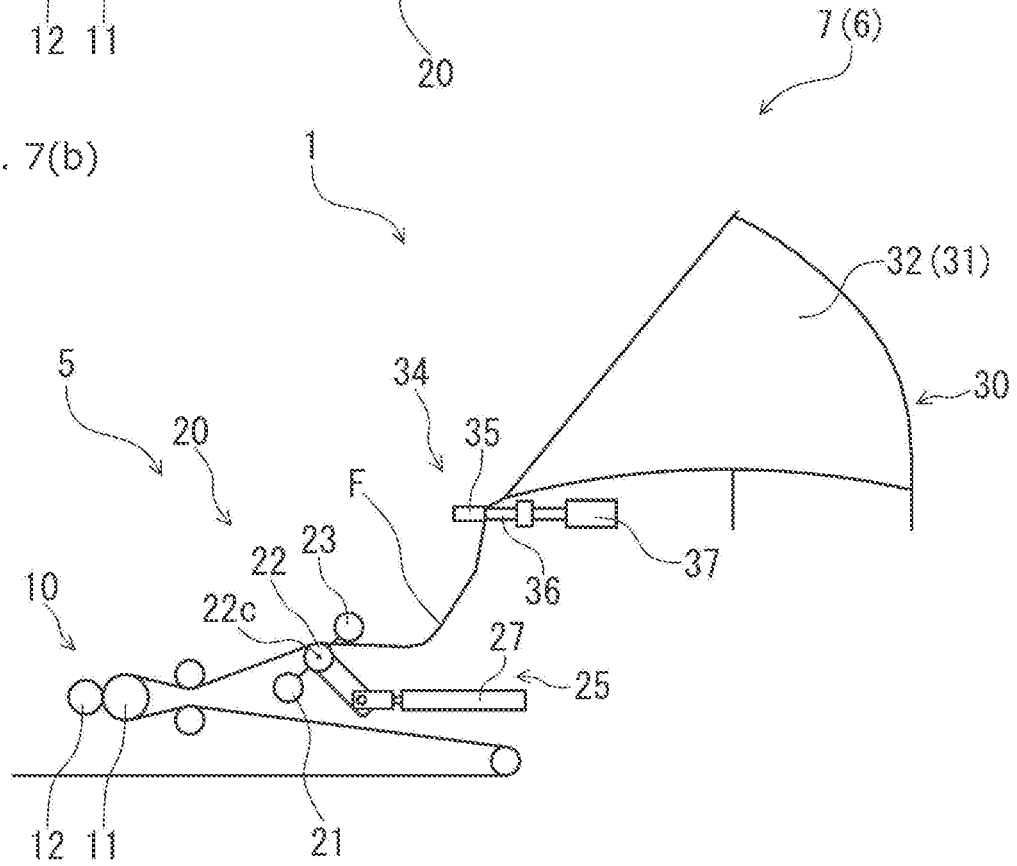

FIGS. 7(*a*) and 7(*b*) are enlarged side views illustrating the film tension releasing step S2 of the manufacturing method of the film packaging bag G with contents, in which FIG. 7(*a*) illustrates a state before tension release and FIG. 7(*b*) illustrates a state after the tension release. For convenience of description, illustration of the supporting member 26 is omitted in FIGS. 7(*a*) and 7(*b*).

The film tension releasing step S2 is performed prior to the supply of the content X into the film F immediately after the film conveying step S1 is completed.

The film tension releasing step S2 has a film clamping step S2*a*, a film loosening step S2*b*, and a rotating belt retreating step S2*c*.

Film Clamping Step S2*a*

In the film clamping step S2*a*, the tubular film F suspended from the bag-making guide 31 is held so as not to move downward.

As illustrated in FIGS. 6(*a*). 6(*b*), 7(*a*) and 7(*b*), the film clamp 34 moves the movable bar 36 toward the fixed bar 35 by the air cylinder 37 so as to grasp the film F. As a result, movement of the film F is regulated.

Since the film clamp 34 is fixed to the sailor suit-like 32, the film F is held on the bag-making guide 31 in the suspended state.

Film Loosening Step S2*b*

In the film loosening step S2*b*, the tension applied to the film F is released.

When the film F is let out from the roll film Fr and conveyed to the filling/packaging portion 8 (web-conveyance), the tension is applied to the film F. This tension of the film F gives a bad influence to weighing of the content X by the weighing portion 40. When the tension of the film F acts on the load cell 41, the weighing (weight measurement) of the content X becomes unstable, and a measurement error occurs. Thus, the weighing of the content X and thus, quantitativity of the content X is lost.

Thus, the film tension releasing portion 20 releases the tension of the film F. Specifically, the tension of the film F laid between the film supply portion 5 and the bag-making/filling/packaging portion 6 is released (loosened). As a result, occurrence of the measurement error in the load cell 41 is prevented so that the weighing of the content X is performed accurately.

FIGS. 6(*a*), 6(*b*), 7(*a*) and 7(*b*)

As illustrated in FIGS. 6(*a*), 6(*b*), 7(*a*) and 7(*b*), the film tension releasing portion 20 moves the driven rollers 21, 23 by the roller moving portion 25. The air cylinder 27 presses the supporting member 26 and rotates (revolves) the driven rollers 21, 23 around the rotating shaft 22*c*.

When the driven rollers 21, 23 are rotated around the rotating shaft 22*c*, the driven rollers 21, 23 are detached from the film F. As a result, the film F laid over the film tension releasing portion 20 is loosened, and the tension is released.

On the other hand, the conveying roller pair 10 holds the film F at all times. Thus, even if the film tension releasing portion 20 is operated, and the tension of the film F is released, the tension of the film F in the film supply portion 5 is maintained. The film F is not loosened, but the tension is maintained from the roll film Fr to the conveying roller pair 10. That is, the tension of film F is released only between the conveying roller pair 10 and the sailor suit-like 32.

Since the conveying roller pair 10 maintains the tension of the film F, occurrence of a wrinkle or meandering in the film F can be avoided when the film conveyance (intermittent conveyance) is resumed. Thus, the film conveyance (intermittent conveyance) can be resumed smoothly.

Rotating Belt Retreating Step S2*c*

In the rotating belt retreating step S2*c*, the rotating belt 51 is moved outward in the width direction so as to be detached from the pipe portion 33 (film F).

When the rotating belt 51 is detached from the pipe portion 33, the bag-making guide unit 30 is separated from the apparatus frame 2. That is, the bag-making guide unit 30 is supported by (placed on) the apparatus frame 2 only through the weighing portion 40.

When the content X is weighed, if the rotating belt 51 is in contact with the bag-making guide unit 30 or the film F, it gives a bad influence to the weighing of the content X by the weighing portion 40 (a measurement error occurs). Thus, as illustrated in FIGS. 6(*a*), 6(*b*), 7(*a*) and 7(*b*), the rotating belt 51 is moved, and the bag-making guide unit 30 is separated from the apparatus frame 2.

On the other hand, the guide roller pairs 62, 63 sandwich the side edges of the film F at all times. However, the guide roller pairs 62, 63 are fixed not to the apparatus frame 2 but to the support frame 38 through the roller support frame 65. Thus, even if the guide roller pairs 62, 63 sandwich the side edges of the film F, a bad influence is not given to the weighing of the content X by the weighing portion 40.

Content Filling/Weighing Step S3

Figure 8A:
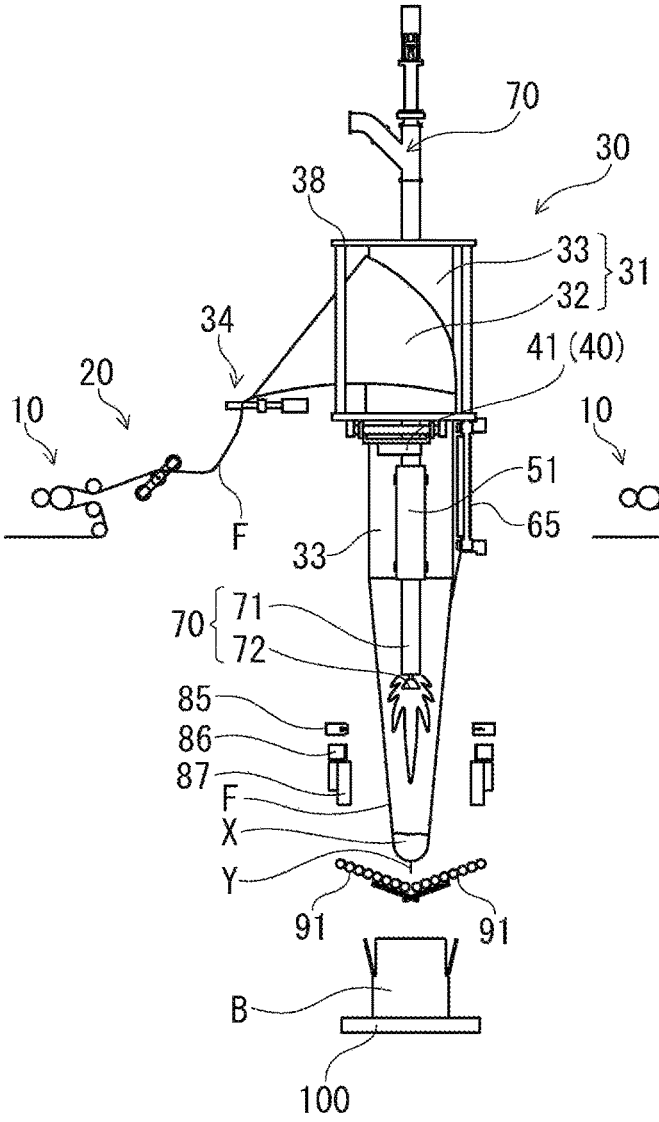
FIGS. 8(*a*) and 8(*b*) are side views illustrating a content filling/weighing step S3 of the manufacturing method of the film packaging bag G with contents, in which FIG. 8(*a*) illustrates a state of a first half of the step and FIG. 8(*b*) illustrates a state of a second half of the step.
Figure 8B:
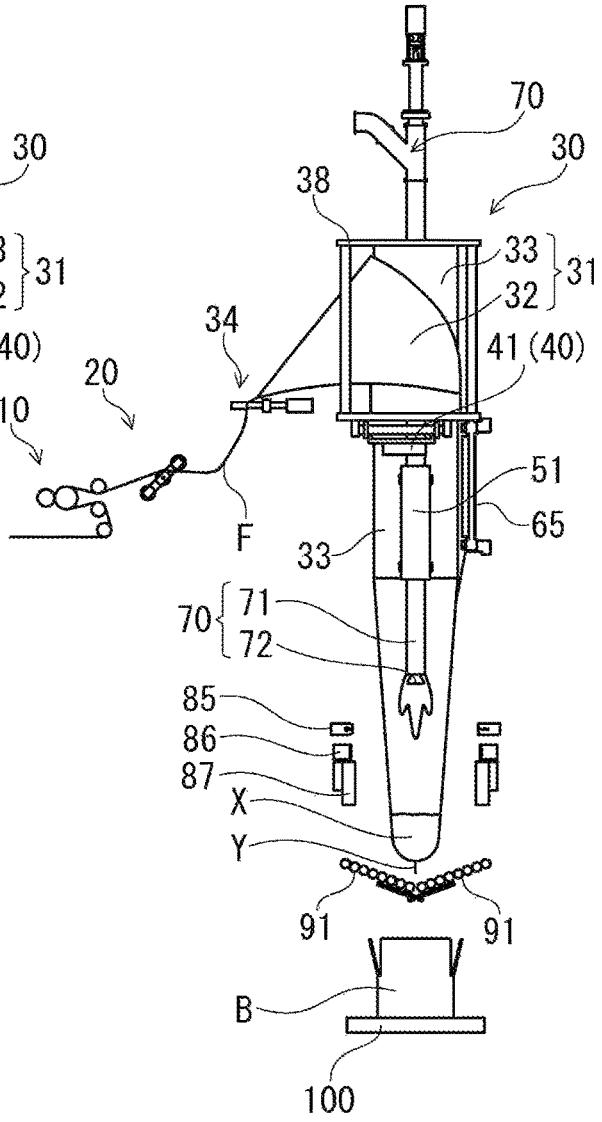

FIGS. 8(*a*) and 8(*b*) are views illustrating the manufacturing method of the film packaging bag G with contents and side views illustrating the content filling/weighing step S3, in which FIG. 8(*a*) illustrates a state of a first half of the step and FIG. 8(*b*) illustrates a state of a second half of the step.

The content filling/weighing step S3 is a step in which the content X is input into the tubular film F and the content X is measured (weight measurement) at the same time. That is, the filling step and the weighing step of the content X are performed at the same time.

First, the weighing portion 40 resets the load cell 41 to zero.

Then, as illustrated in FIG. 8(*a*), the filling portion 70 releases the shutter 72 and further drives the liquid-feeding pump so as to discharge (supply) the content X from the nozzle 71. The weighing portion 40 starts weight measurement of the content X filled in the tubular film F by the two load cells 41. The weighing portion 40 outputs a measurement result of the content X to the control portion on a real time basis.

As illustrated in FIG. 8(*b*), when the weight of the content X gets close to the target weight (target value), the filling portion 70 reduces a flowrate of the liquid-feeding pump and decreases the opening degree of the shutter 72 (suppresses the input amount). Then, when the weight of the content X reaches the target weight, the filling portion 70 stops the liquid-feeding pump and closes the shutter 72.

Since the bag-making/filling/packaging portion 6 weighs the content X while inputting the content X into the tubular film F, the weight of the content X (filled amount, input amount) can be made constant.

Moreover, when the content X is weighed, the bag-making guide unit 30 is supported by the apparatus frame 2 only through the weighing portion 40. Furthermore, the tension of the film F laid between the film supply portion 5 and the bag-making/filling/packaging portion 6 is released. That is, the film F is in a state substantially supported only by the bag-making guide unit 30.

Therefore, the weighing portion 40 can accurately measure the weight of the content X filled in the tubular film F. Thus, quantitativity of the content X is improved.

Lateral Sealing Step S4

Figure 9A:
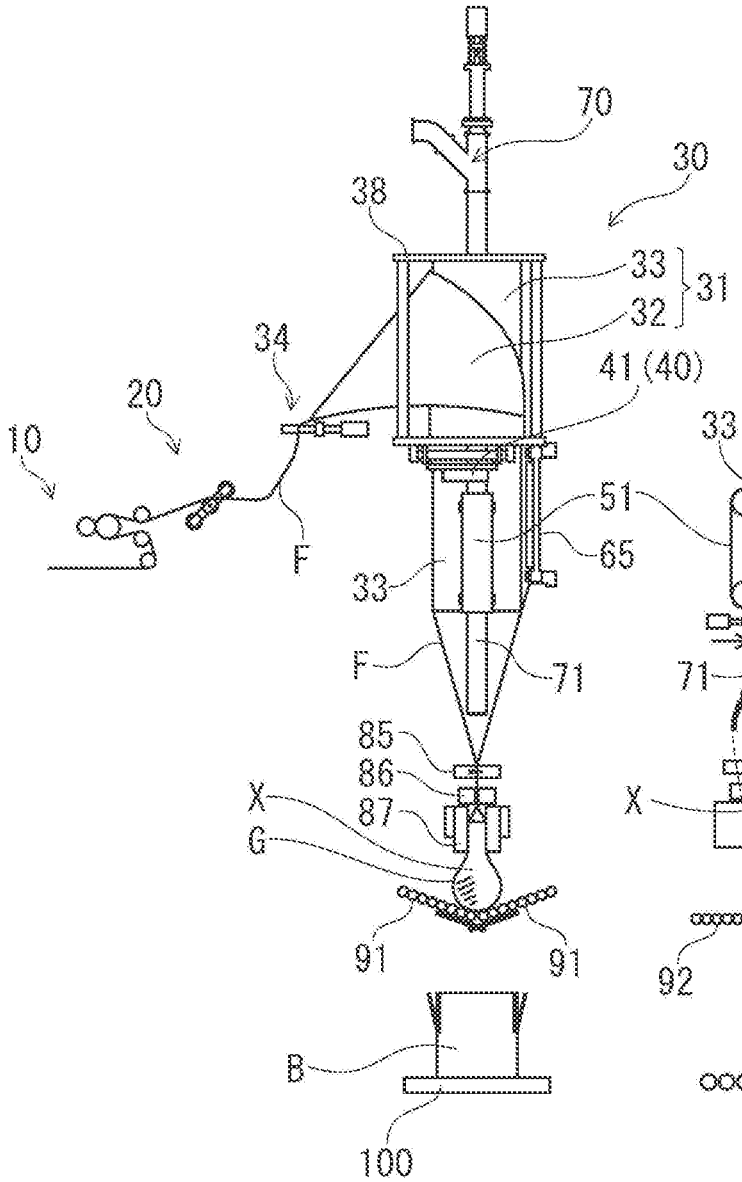
FIGS. 9(*a*) and 9(*b*) are views illustrating a lateral sealing step S4 of the manufacturing method of the film packaging bag G with contents, in which FIG. 9(*a*) is a side view and FIG. 9(*b*) is a front view.
Figure 9B:
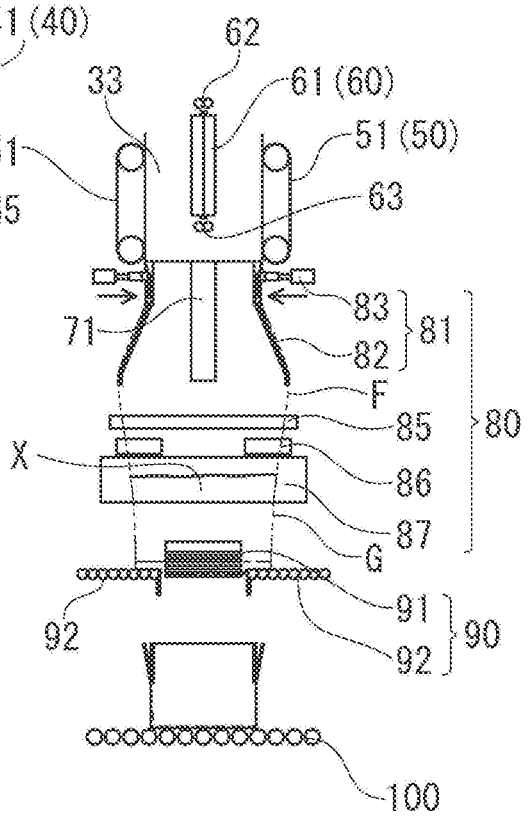

FIGS. 9(*a*) and 9(*b*) are views illustrating the lateral sealing step S4 of the manufacturing method of the film packaging bag G with contents, in which FIG. 9(*a*) is a side view and FIG. 9(*b*) is a front view.

The lateral sealing step S4 is a step in which the tubular film F is heat-sealed across the lateral direction, and the film packaging bag G is formed. The lateral sealing step S4 is also a manufacturing step of the subsequent film packaging bag G (lateral sealing step S0*c*).

First, as illustrated in FIG. 9(*b*), the rotating belt 51 is pressed onto the pipe portion 33, and the film F is sandwiched. At this time, the rotating belt 51 is not rotated but holds the film F.

Then, as illustrated in FIG. 9(*b*), the flattening mechanism 81 expands the film F in the lateral direction and flatten it. The air cylinder 83 presses the guide rod 82 so as to swing the guide rod 82 outward in the lateral direction. A part of the tubular film F (a part upward from the film packaging bag G) is extended in the lateral direction and flattened by pressing the inner surface of the film F by the pair of guide rods 82 outward in the lateral direction.

Subsequently, as illustrated in FIG. 9(*a*), the deaerating plate 87 is moved inward in the front-and-rear direction and presses the content X filled in the film F. As a result, the upper end side of the film packaging bag G is flattened, and the content X is pushed up to immediately below the lateral heater 85.

Subsequently, as illustrated in FIG. 9(*a*), the wrinkle removing portion 86 is moved inward in the front-and-rear direction and grasps the outer side of the film F in the lateral direction. As a result, extension/contraction of the film F in the lateral direction becomes difficult.

Moreover, as illustrated in FIG. 9(*a*), the lateral heater 85 is moved inward in the width direction and sandwiches the film F across the lateral direction. As a result, the lateral seal Y is formed in the film F, and the film packaging bag G with the content X is formed (manufactured).

Vertical Sealing Step S0*b*: Manufacturing Step of Subsequent Film Packaging Bag G At the same time as the formation of the lateral seal Y, the vertical seal T is formed. The vertical heater 61 is moved inward in the width direction and sandwiches both of the side edges of the film F. As a result, the vertical seal T is formed in the film F.

Bag-Body Cutting-Off Step S5

Figure 10A:
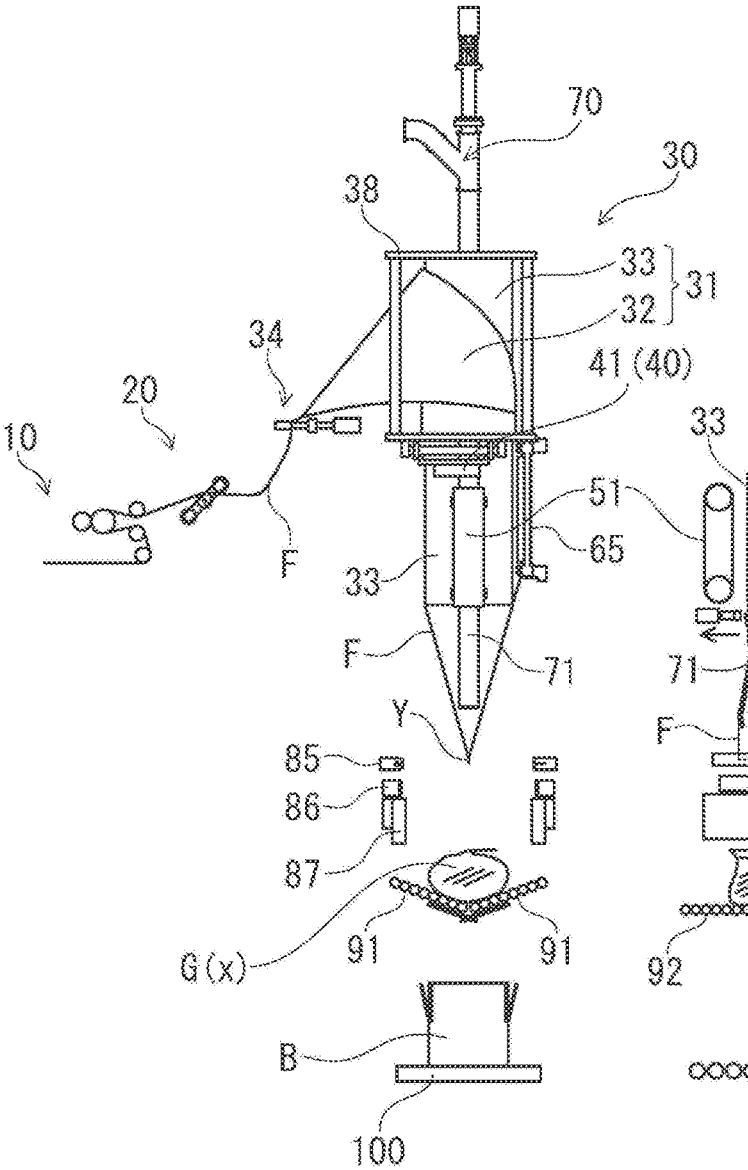
FIGS. 10(*a*) and 10(*b*) are views illustrating a bag-body cutting-off step S5 of the manufacturing method of the film packaging bag G with contents, in which FIG. 10(*a*) is a side view and FIG. 10(*b*) is a front view.
Figure 10B:
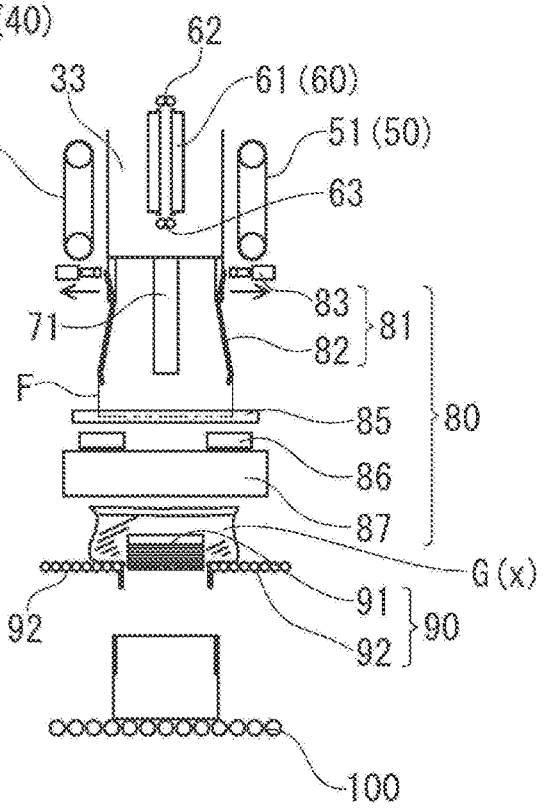

FIGS. 10(*a*) and 10(*b*) are views illustrating a bag-body cutting-off step S5 of the manufacturing method of the film packaging bag G with contents, in which FIG. 10(*a*) is a side view and FIG. 10(*b*) is a front view.

The bag-body cutting-off step S5 is a step of cutting off the film packaging bag G from the film F.

First, the lateral heater 85 cuts the lateral seal Y in the upper-and-lower direction (into equal two parts) by a cutter built in one of the heater bars. As a result, the film packaging bag G is cut off from the film F.

Then, the vertical heater 61 is moved outward in the width direction so as to be detached from the film F. Moreover, the wrinkle removing portion 86 and the deaerating plate 87 are moved outward in the front-and-rear direction and are separated from the film F. Furthermore, the flattening mechanism 81 swings the guide rod 82 inward in the lateral direction by the air cylinder 83 so as to stop flattening of the film F.

As illustrated in FIGS. 10, the lateral heater 85 is moved outward in the front-and-rear direction so as to be detached from the film F. As a result, the film packaging bag G is detached from the lateral heater 85 and is supported only by (placed on) the bag supporting portion 90.

Boxing Step S6

Figure 11A:
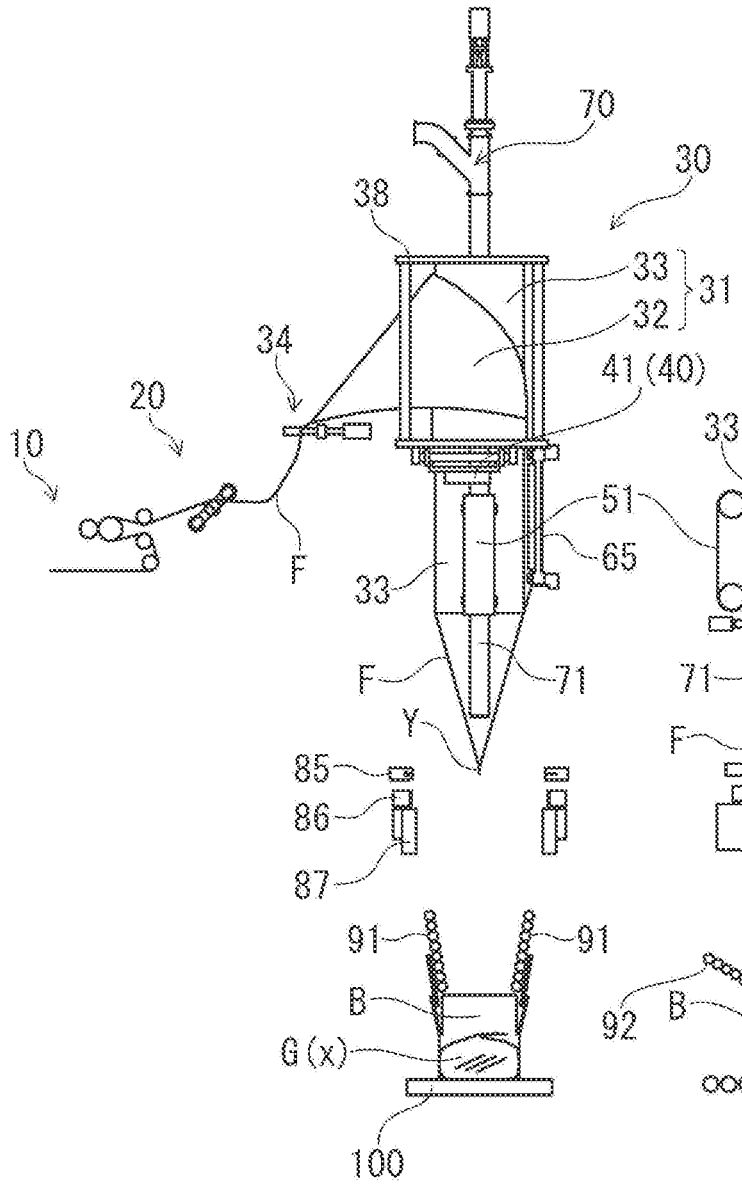
FIGS. 11(*a*) and 11(*b*) are views illustrating a boxing step S6 of the manufacturing method of the film packaging bag G with contents, in which FIG. 11(*a*) is a side view and FIG. 11(*b*) is a front view.
Figure 11B:
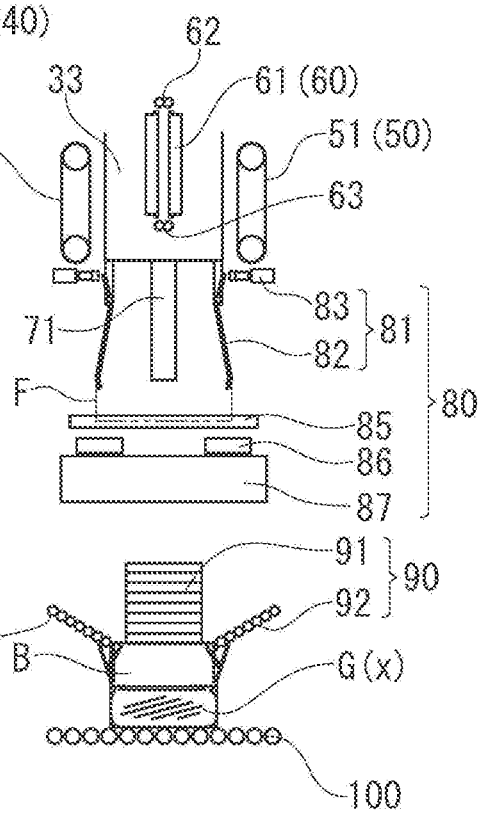

FIGS. 11(*a*) and 11(*b*) are views illustrating a boxing step S6 of the manufacturing method of the film packaging bag G with contents, in which FIG. 11(*a*) is a side view and FIG. 11(*b*) is a front view.

The boxing step S6 is a step in which the film packaging bag G is transferred from the bag supporting portion 90 and is packed in the cardboard box B.

First, the bag supporting portion 90 swings the roller conveyors 91, 92 downward so as to make the film packaging bag G fall downward. When the roller conveyors 91, 92 are swung downward, a space through which the film packaging bag G falls is formed between the roller conveyors 91, 92.

The cardboard box B is disposed in advance immediately below the film packaging bag G. The cardboard box B is carried into the filling/packaging portion 8 in the state with the upper lid open (in the state where the outer flap and the inner flap are upright perpendicularly).

When the roller conveyors 91, 92 are swung downward, they abut to an inner surface of the upper lid of the cardboard box B (outer flap, inner flap) and push up the upper lid to the outer side.

As illustrated in FIGS. 11(*a*) and 11(*b*), when the roller conveyors 91, 92 are swung downward, the film packaging bag G slides down along the roller conveyors 91, 92 and is accommodated in the cardboard box B. At this time, the film packaging bag G is accommodated in the cardboard box B in little contact with the upper lid of the cardboard box B. Since the film packaging bag G is not caught or rubbed by the upper lid of the cardboard box B, a scratch or a pinhole is not generated in the film packaging bag G. After the film packaging bag G falls, the roller conveyors 91, 92 are swung upward again and take a substantially horizontal attitude.

Then, the cardboard box B accommodating the film accommodating bag G is carried out of the bag-making/filling/packaging portion 6. As described above, the step of manufacturing the film packaging bag G with contents is completed.

The vertical bag-making/filling/packaging machine 1 cancels the action of the film tension releasing step S2 for performing the manufacturing step of the subsequent film packaging bag G. First, the rotating belt 51 is moved inward in the width direction and is brought into close contact with the pipe portion 33 (film F). Then, the driven rollers 21, 23 are brought into close contact with the film F, and a tension is given to the film F. Moreover, the movable bar 36 is detached from the fixed bar 35 so that the film F can be carried.

Then, the new cardboard box B is carried into immediately below the bag supporting portion 90.

The vertical bag-making/filling/packaging machine 1 repeats the step of manufacturing the film packaging bag G with contents. The vertical bag-making/filling/packaging machine 1 continuously repeats steps from the film conveying step S1 to the boxing step S6.

As described above, the vertical bag-making/filling/packaging machine 1 continuously manufactures a plurality of the film packaging bags G with contents.

As described above, the vertical bag-making/filling/packaging machine 1 performs weighing of the content X by the weighing portion 40 at the same time as the filling of the content X. At this time, the vertical bag-making/filling/packaging machine 1 releases (loosens) the tension applied to the film F by the film tension releasing portion 20. Moreover, the film F is held on the bag making guide 31 by the film clamp 34.

Thus, the weighing portion 40 can measure the weight change of the film F suspended from the bag making guide 31 without being influenced by the tension of the film F. That is, the weighing portion 40 can accurately weigh the content X filled in the film F (weight measurement). Therefore, the vertical bag-making/filling/packaging machine 1 can fill a constant amount of the content X in the film packaging bag G.

Thus, the vertical bag-making/filling/packaging machine 1 can continuously manufacture the film packaging bag G excellent in quantitativity of the content X.

Since the film tension releasing portion 20 moves (revolves) the driven rollers 21, 23, the tension of the film F can be released without increasing the size of the apparatus. Moreover, since the air cylinder 27 is disposed on the outer surface side of the film F, contamination on the inner surface of the film F can be avoided.

Since the film supply portion 5 includes the conveying roller pair 10, the tension of the film F can be maintained. Thus, when the film tension releasing portion 20 is returned, and conveyance of the film F is resumed, occurrence of a wrinkle or meandering in the film F can be prevented.

Since the film conveying portion 50 is separated from the bag-making guide unit 30 (bag making guide 31), it does not give a bad influence to the measurement by the weighing portion 40.

Since the vertical heater 61 is separated from the bag-making guide unit 30 (bag making guide 31) in the vertical sealing portion 60, it does not give a bad influence to the measurement by the weighing portion 40. On the other hand, since the guide roller pairs 62, 63 are coupled to the bag making guide 31, conveyance of the film F can be resumed while the state where the side edges of the film F are in close contact with each other is maintained.

Since the filling portion 70 includes the shutter 72 and the liquid feeding pump, the filled amount and a filling speed of the content X to the film F (film packaging bag G) can be accurately controlled.

Since the bag supporting portion 90 supports the film packaging bag G by the roller conveyors 91, 92 and conveys it toward the cardboard box B, efficiency of a packing work can be improved.

Moreover, since the roller conveyors 91, 92 opens the upper lid of the cardboard box B widely, the film packaging bag G can be accommodated in the cardboard box B without touching the upper lid. Therefore, occurrence of a pinhole and the like in the film packaging bag G can be prevented.

The present invention is not limited to the aforementioned embodiment but includes those with various modifications added to the aforementioned embodiment within a range not departing from the gist of the present invention. That is, specific shapes, configurations and the like cited in the aforementioned embodiment are only examples and capable of appropriate changes.

For example, in the aforementioned embodiment, the pillow packaging bag was described as an example of the film packaging bag G. However, the film packaging bag G may be a three-way sealed packaging bag or four-way sealed packaging bag. The film packaging bag G may be an octagonal packaging bag, for example.

The film F is not limited to a band shape. The film F may be an inflation film. When the inflation film is used, a directional change roller or the like is used instead of the bag making guide 31 as the film engaging portion.

The film packaging bag G may be formed of a plurality of sheets of band-shaped film.

The content X is not limited to a liquid or a fluid but may be a liquid or a fluid containing a solid. Moreover, the content X may be only a solid such as a food and a snack.

The film tension releasing portion 20 may causes any one of the driven rollers 21, 23, rather than both of the driven rollers 21, 23, to be brought into close contact with the film F or to be detached from the film F.

For the film tension releasing portion 20, the driven rollers 21, 23 are not necessarily revolved around the rotating shaft 22*c*. The driven rollers 21, 23 may be moved in parallel.

The film tension releasing portion 20 does not necessarily include a plurality of the rollers. The film tension releasing portion 20 only needs to include at least one or more driven rollers which are brought into close contact with or detached from the film F.

The roller conveyors 91, 92 of the bag supporting portion 90 may be belt conveyors. The conveying conveyor 100 may be a belt conveyor.

The accommodating box is not limited to a cardboard box. The accommodating box may be a plastic container or an 18-liter metal can.

The film packaging bag G with contents is not necessarily accommodated in an accommodating box such as the cardboard box B. The film packaging bag G with contents may be placed on the conveying conveyor 100 as it is and carried out from the vertical bag-making/filling/packaging machine 1 without being put in the accommodating box. In this case, a belt conveyor is used for the conveying conveyor 100, not the roller conveyor.

The number of the nozzles 71 of the filling portion 70 is not limited to one. It may have both a large-diameter nozzle and a small-diameter nozzle. The large-diameter nozzle and the small-diameter nozzle may have shutters, respectively, and can open/close the shutters individually.

In the first half of the content filling/weighing step S3, the content X is discharged by opening the respective shutters of the large-diameter nozzle and the small-diameter nozzle (the input amount is increased). In the second half of the content filling/weighing step S3 (particularly before the filling is stopped), the shutter of the large-diameter nozzle is closed, and the content X is discharged only from the small-diameter nozzle (the input amount is suppressed).

Since the filling portion 70 includes the large-diameter nozzle and the small-diameter nozzle, filling time can be shortened. Moreover, since the content X is discharged only from the small-diameter nozzle before the filling is stopped, a filling error when the filling is stopped is made smaller, and the weight of the content X (filled amount) can be made more accurate (constant).

REFERENCE NUMERALS

1 vertical bag-making/filling/packaging machine
2 apparatus frame
5 film supply portion
6 bag-making/filling/packaging portion
7 bag making portion
8 filling/packaging portion
10 conveying roller pair (second film clamp)
11 driving roller
12 driven roller
13 driving motor
20 film tension releasing portion
21, 22 driven roller (first driven roller)
22*c* rotating shaft
23 driven roller (second driven roller)
25 roller moving portion
26 supporting member
27 air cylinder
30 bag-making guide unit
31 bag-making guide (film engaging portion)
32 sailor suit-like
33 pipe portion
34 film clamp
35 fixed bar
36 movable bar
37 air cylinder
38 support frame
40 weighing portion
41 load cell
50 film conveying portion
51 rotating belt
60 vertical sealing portion
61 vertical heater
62, 63 guide roller pair
65 roller support frame
70 filling portion
71 nozzle
72 shutter
80 lateral sealing portion
81 flattening mechanism
82 guide rod
83 air cylinder
85 lateral heater
86 wrinkle removing portion
87 deaerating plate
90 bag supporting portion
91, 92 roller conveyor
100 conveying conveyor (bag-body carrying-out portion)
F film
Fr roll film
G film packaging bag 8bag body)
Y lateral seal
X content
B cardboard box (accommodating box)

The invention claimed is:

1. A vertical bag-making/filling/packaging machine, comprising:

a film supply portion which lets out a film from a roll;

a film engaging portion which is engaged with the film and changes a conveying direction downward;

a vertical sealing portion which heat-seals side edges of the film to each other so as to make the film into a tubular shape;

a film conveying portion which conveys the film downward;

a film clamp which is located at an upstream end of the film engaging portion and clamps the film;

a film tension releasing portion which is located at a most downstream end of the film supply portion and loosens the film laid between the film supply portion and the film engaging portion;

a second film clamp which is located upstream of the film tension releasing portion, and clamps the film so as to maintain a tension of the film when the film tension releasing portion is operated;

a filling portion which inputs a content to an interior of the film suspended from the film engaging portion;

a weighing portion which weighs a weight of the input content based on a weight increase of the film engaging portion;

a lateral sealing portion which heat-seals the film in a width direction so as to make a bag body; and a cutter which cuts off the bag body from the film, wherein the film tension releasing portion comprises:

a first driven roller and a second driven roller disposed in parallel; and a roller moving portion configured to revolve the first driven roller and the second driven roller in parallel, so as to move the first driven roller and the second driven roller alternately between a before-tension-release state wherein the first driven roller and the second driven roller are in contact with the film, and an after-tension-release state wherein at least one of the first driven roller and the second driven roller is detached from the film.

2. The vertical bag-making/filling/packaging machine according to claim 1, wherein the film engaging portion comprises a folded member having a shape of a sailor collar which folds the film into the tubular shape.

3. The vertical bag-making/filling/packaging machine according to claim 1, wherein the roller moving portion is disposed on an outer surface side of the film.

4. The vertical bag-making/filling/packaging machine according to claim 1, wherein the film clamp is coupled to the film engaging portion.

5. The vertical bag-making/filling/packaging machine according to claim 1, wherein the second film clamp comprises a conveying roller pair which sandwiches the film.

6. The vertical bag-making/filling/packaging machine according to claim 1, wherein the weighing portion comprises a pair of load cells, and the film engaging portion is laid over the pair of load cells.

7. The vertical bag-making/filling/packaging machine according to claim 1, wherein the film conveying portion is separated from the film engaging portion, and when the film tension releasing portion is operated, the film conveying portion is detached from the film.

8. The vertical bag-making/filling/packaging machine according to claim 1, wherein the vertical sealing portion comprises:

a vertical heater separated from the film engaging portion; and a guide roller pair coupled to the film engaging portion and sandwiching side edges of the film above and below the vertical heater, and the vertical heater is detached from the film when the film tension releasing portion is operated.

9. The vertical bag-making/filling/packaging machine according to claim 1, wherein the filling portion comprises:

a nozzle which discharges the content;

a shutter which adjusts an opening degree of the nozzle; and a pump which transports the content toward the nozzle.

10. The vertical bag-making/filling/packaging machine according to claim 1, comprising a pair of deaerating plates which is disposed immediately below the lateral sealing portion and regulates a thickness of the bag body when the lateral sealing portion is operated.

11. The vertical bag-making/filling/packaging machine according to claim 1, comprising a bag supporting portion disposed below the lateral sealing portion and supporting a bottom of the bag body when the lateral sealing portion is operated, and the bag supporting portion conveys the bag body toward a bag-body carrying-out portion after the cutter is operated.

12. The vertical bag-making/filling/packaging machine according to claim 11, wherein the bag supporting portion comprises a conveyor and swings the conveyor downward so as to slide the bag body down.

13. The vertical bag-making/filling/packaging machine according to claim 12, wherein the bag-body carrying-out portion conveys an accommodating box below the bag supporting portion, and the bag supporting portion swings the conveyor so as to open an upper lid of the accommodating box widely.

14. A manufacturing method of a film packaging bag with contents, comprising:

a film supplying step in which a film supply portion lets out a film from a roll;

a film engaging step in which a conveying direction of the film let out from the roll is changed downward via a film engaging portion;

a vertical sealing step in which side edges of the film are heat-sealed to each other so as to form a tubular shape;

a film conveying step in which the film is conveyed downward;

a film clamping step in which a film clamp located at an upstream end of the film engaging portion clamps the film and holds the film on the film engaging portion;

a film tension releasing step in which a film tension releasing portion located at a most downstream end of the film supply portion releases the film spanned between the film supply portion and the film engaging portion;

a film tension maintaining step in which a second film clamp located upstream of the film tension releasing portion clamps the film and maintains a tension of the film in the film supply portion;

a filling step in which the content is input to an interior of the film suspended from the film engaging portion;

a weighing step in which a weighing portion weighs a weight of the input content based on a weight increase of the film engaging portion;

a lateral sealing step in which the film is heat-sealed in a lateral direction so as to make a bag body; and a bag-body cutting-off step in which the bag body is cut off from the film, wherein the film tension releasing portion has a first driven roller and a second driven roller which are laid over the film, and a roller moving portion which moves the first driven roller and the second driven roller in parallel; and in the film tension releasing step, the roller moving portion revolves the first driven roller and the second driven roller in parallel, so as to detach the first driven roller and the second driven roller from the film.

15. The manufacturing method of the film packaging bag with contents according to claim 14, wherein the film tension releasing step comprises a retreating step in which the film conveying portion for conveying the film is detached from the film.

16. The manufacturing method of the film packaging bag with contents according to claim 14, comprising a boxing step in which, after the bag body is supported by the conveyor, the conveyor is swung downward so as to convey the bag body toward the accommodating box.

17. The manufacturing method of the film packaging bag with contents according to claim 14, wherein, in the filling step, an input amount of the content is suppressed when a weighing result obtained in the weighing step gets closer to a target value.

* * * * *